US007001702B2

(12) United States Patent
Cheng et al.

(10) Patent No.: US 7,001,702 B2
(45) **Date of Patent: *Feb. 21, 2006**

(54) TONER PROCESSES

(75) Inventors: Chieh-Min Cheng, Rochester, NY (US); Pinyen Lin, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 177 days.

This patent is subject to a terminal disclaimer.

(21) Appl. No.: 10/647,489

(22) Filed: Aug. 25, 2003

(65) Prior Publication Data

US 2005/0048389 A1 Mar. 3, 2005

(51) Int. Cl.
*G03G 9/087* (2006.01)

(52) U.S. Cl. ..... 430/109.3; 430/137.14

(58) Field of Classification Search ..... 430/109.3, 430/109.4, 137.14, 137.15
See application file for complete search history.

(56) References Cited

U.S. PATENT DOCUMENTS 4,797,339 A 1/1989 Maruyama et al. ..... 430/109
4,983,488 A 1/1991 Tan et al. ..... 430/137
4,990,424 A * 2/1991 Van Dusen et al. ..... 430/108.8
4,996,127 A 2/1991 Hasegawa et al. ..... 430/109
5,057,392 A * 10/1991 McCabe et al. ..... 430/109.2
5,238,998 A * 8/1993 Fuller et al. ..... 525/98
5,281,659 A * 1/1994 Weaver et al. ..... 525/50
5,312,704 A * 5/1994 Fuller et al. ..... 430/45
5,994,020 A 11/1999 Patel et al. ..... 430/137
6,132,924 A 10/2000 Patel et al. ..... 430/137
6,210,853 B1 4/2001 Patel et al. ..... 430/137
6,268,102 B1 7/2001 Hopper et al. ..... 430/137.14
6,268,103 B1 7/2001 Hopper et al. ..... 430/137.14
6,352,810 B1 3/2002 Jiang et al. ..... 430/137.11
6,395,442 B1 5/2002 Hayashi et al. ..... 430/109.4
6,416,920 B1 7/2002 Hopper et al. ..... 430/137.14
6,495,302 B1 12/2002 Jiang et al. ..... 430/137.14
6,500,597 B1 12/2002 Patel et al. ..... 430/137.14
6,562,541 B1 5/2003 Vanbesien et al. ..... 430/137.14
6,576,389 B1 6/2003 Vanbesien et al. ..... 430/137.14
6,830,860 B1 * 12/2004 Sacripante et al. ..... 430/109.3
6,841,329 B1 * 1/2005 Nguyen et al. ..... 430/137.14

* cited by examiner

*Primary Examiner*—John L Goodrow
(74) *Attorney, Agent, or Firm*—E. O. Palazzo

(57) ABSTRACT

A toner containing a mixture of a semicrystalline polymer, an amorphous polymer and a crystalline polyolefin; and a colorant.

34 Claims, No Drawings

TONER PROCESSES

RELATED PATENTS

Illustrated in U.S. Pat. No. 6,495,302; U.S. Pat. No. 6,500,597; U.S. Pat. No. 6,416,920; U.S. Pat. No. 6,562,541; and U.S. Pat. No. 6,576,389, the disclosures of which are totally incorporated herein by reference, are emulsion/aggregation toner processes wherein a coagulant may be selected.

In U.S. Pat. No. 6,132,924, the disclosure of which is totally incorporated herein by reference, there is illustrated a process for the preparation of toner comprising mixing a colorant, a latex, and two coagulants, followed by aggregation and coalescence, and wherein one of the coagulants may be polyaluminum chloride.

In U.S. Pat. No. 6,268,102, the disclosure of which is totally incorporated herein by reference, there is illustrated a process for the preparation of toner comprising mixing a colorant, a latex, and two coagulants, followed by aggregation and coalescence, and wherein one of the coagulants is a polyaluminum sulfosilicate.

In U.S. Pat. No. 6,352,810, the disclosure of which is totally incorporated herein by reference, is illustrated, for example, a process of preparing a toner comprising (i) aggregating with a coagulant of a polyamine salt, a colorant, dispersion with a latex emulsion and optional additives to form aggregates followed by optionally adding a second latex emulsion to the formed aggregates;

(ii) adding an oxidizing agent to remove the excess coagulant followed by a changing the pH with a base, heating to coalesce or fuse the aggregates;

(iii) lowering the pH to accelerate the coalescence process and optionally isolating, washing and drying the toner.

Illustrated in U.S. Pat. No. 5,994,020, the disclosure of which are totally incorporated herein by reference, are toner processes, and more specifically, a process for the preparation of toner comprising (i) preparing, or providing a colorant dispersion;

(ii) preparing, or providing a functionalized wax dispersion comprised of a functionalized wax contained in a dispersant mixture comprised of a nonionic surfactant, an ionic surfactant, or mixtures thereof;

(iii) shearing the resulting mixture of the functionalized wax dispersion (ii) and the colorant dispersion (i) with a latex or emulsion blend comprised of resin contained in a mixture of an anionic surfactant and a nonionic surfactant;

(iv) heating the resulting sheared blend of (iii) below about the glass transition temperature (Tg) of the resin particles;

(v) optionally adding additional anionic surfactant to the resulting aggregated suspension of (iv) to prevent, or minimize additional particle growth of the resulting electrostatically bound toner size aggregates during coalescence (iv);

(vi) heating the resulting mixture of (v) above about the Tg of the resin; and optionally, (vii) separating the toner particles; and a process for the preparation of toner comprising blending a latex emulsion containing resin, colorant, and a polymeric additive; adding an acid to achieve a pH of about 2 to about 4 for the resulting mixture; heating at a temperature about equal to, or about below the glass transition temperature (Tg) of the latex resin; optionally adding an ionic surfactant stabilizer; heating at a temperature about equal to, or above about the Tg of the latex resin; and optionally cooling, isolating, washing, and drying the toner.

The appropriate components and processes of the above recited patents may be selected for the processes of the present invention in embodiments thereof.

BACKGROUND

Disclosed are toners and processes thereof, and more specifically, chemical toner processes which involve the aggregation of a latex, especially three latexes, each containing a dissimilar resin, colorant like pigment, or dye, and optional additive particles followed by the fusion of the aggregates resulting into toner particles, and optionally wherein aggregation can be primarily controlled by utilizing a coagulant, such as a coagulant of a polyamine salt comprising, for example, salts obtained by reacting tri(2-aminoethyl) citrate with an acid, and more specifically, wherein there are selected individual latexes comprised of, for example, submicron resin particles of about 0.1 to about 0.5 micron in volume average diameter suspended in an aqueous phase of water, and an anionic surfactant, and optionally a nonionic to which is added a colorant dispersion comprising, for example, submicron colorant particles of, for example, about 0.08 to about 0.3 micron in volume average diameter, anionic surfactant, optionally a nonionic surfactant, or mixtures thereof, anionic and a nonionic surfactant comprising, for example, from about 40:60 to about 60:40 weight percent mixtures of anionic to nonionic surfactant thereof, and optionally adding a wax dispersion comprising submicron wax particles of a size of, for example, about 0.1 to about 0.3 micron in volume average diameter suspended in an aqueous phase of water and an anionic surfactant, and wherein the resultant blend is stirred and heated to a temperature below the resin Tg, resulting in aggregates to which optionally is added a second latex, followed by heating the mixture to a temperature above the resin Tg to fuse the aggregates.

Yet more specifically in embodiments there are disclosed toners generated from a first latex containing a semicrystalline polymer, a second latex containing an amorphous polymer and a third latex containing a crystalline, especially a high crystalline, polyolefin. The crystallinity of the polymer refers, for example, to the ordering of macromolecular chains; the amorphous polymer (no ordering in the chain structures) of the macromolecular chains exhibiting random packing of the chains; and for the semicrystalline polymers a combination of a crystalline portion and an amorphous portion in the chain structures. Many techniques have been developed to analyze and measure the crystallinity of polymers, including Infrared (IR) Spectroscopy, X-ray diffraction (XRD), differential scanning calorimetry (DSC), nuclear magnetic resonance (NMR) spectroscopy, Raman spectroscopy and neutron scattering. Semicrystalline polymers contain, for example, about 10 percent to about 60 percent, and preferably about 12 percent to about 50 percent crystallinity; high crystalline polymers have about 60 percent to about 95 percent, and preferably, about 65 percent to about 90 percent crystallinity; and amorphous polymers have about or less than about 1 percent crystallinity.

The toners generated with the processes disclosed herein are especially useful for imaging processes, especially xerographic processes, digital imaging processes, color processes and the like, and wherein a number of advantages are enabled in embodiments, such as excellent fusing characteristics, minimal undesirable offset properties, acceptable toner minimum fixing temperature, which temperature is, for example, about 100° C., or less, and more specifically, from about 80° C. to about 100° C.

REFERENCES

In xerographic systems, especially color systems, small sized toners of from about 2 to about 8 microns can be important to the achievement of high image quality for process color applications. It is also of value to have a low image pile height to eliminate, or minimize image feel and avoid paper curling after fusing. Paper curling can be particularly pronounced in xerographic color processes primarily because of the presence of relatively high toner coverage as a result of the application of three to four color toners. During fusing, moisture escapes from the paper due to high fusing temperatures of from about 120° C. to about 200° C. In the situation wherein only one layer of toner is selected, such as in one-color black or highlight color xerographic applications, the amount of moisture driven off during fusing can be reabsorbed by the paper and the resulting print remains relatively flat with minimal paper curl. In process color where toner coverage is high, the relatively thick toner plastic covering on the paper can inhibit the paper from reabsorbing the moisture, and cause substantial paper curling. These and other imaging shortfalls and problems are avoided or minimized with the toners and processes of the present invention.

Also, one can select certain toner particle sizes, such as from about 2 to about 10 microns, and with a high colorant, especially pigment loading, such as from about 4 to about 15 percent by weight of toner, so that the mass of toner necessary for attaining the required optical density and color gamut can be significantly reduced to eliminate or minimize paper curl. Lower toner mass also ensures the achievement of image uniformity. However, higher pigment loading often adversely affects the charging behavior of toners. For example, the charge levels may be too low for proper toner development, or the charge distributions may be too wide and toners of wrong charge polarity may be present. Furthermore, higher pigment loadings may also result in toner charging behavior sensitivity to changes in environmental conditions such as temperature and humidity. Toners prepared in accordance with the processes of the present invention minimize, or avoid these disadvantages.

There is illustrated in U.S. Pat. No. 4,996,127, the disclosure of which is totally incorporated herein by reference, a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. In U.S. Pat. No. 4,983,488, the disclosure of which is totally incorporated herein by reference, there is disclosed a process for the preparation of toners by the polymerization of a polymerizable monomer dispersed by emulsification in the presence of a colorant and/or a magnetic powder to prepare a principal resin component, and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70 microns, are obtained. Illustrated in other prior art, such as U.S. Pat. No. 4,797,339, the disclosure of which is totally incorporated herein by reference, is a process for the preparation of toners by resin emulsion polymerization, wherein similar to the '127 patent certain polar resins are selected; and U.S. Pat. No. 4,558,108, the disclosure of which is totally incorporated herein by reference, wherein there is disclosed a process for the preparation of a copolymer of styrene and butadiene by specific suspension polymerization. Other prior art includes U.S. Pat. Nos. 3,674,736; 4,137,188 and 5,066,560, the disclosures of which are totally incorporated herein by reference.

In U.S. Pat. No. 6,395,442, the disclosure of which is totally incorporated herein by reference, there is illustrated a toner containing a resin binder that can be generated from a crystalline material and an amorphous polymer in a water based medium.

In U.S. Pat. No. 6,268,103, the disclosure of which is totally incorporated herein by reference, there is illustrated emulsion/aggregation toner processes and wherein functional waxes are used.

In U.S. Pat. No. 6,210,853, the disclosure of which is totally incorporated herein by reference, there is illustrated a toner containing a second resin binder.

Emulsion/aggregation/coalescence processes for the preparation of toners are illustrated in a number of Xerox patents, the disclosures of each of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797; and also of interest may be U.S. Pat. Nos. 5,348,832; 5,405,728; 5,366,841; 5,496,676; 5,527,658; 5,585,215; 5,650,255; 5,650,256; 5,501,935; 5,723,253; 5,744,520; 5,763,133; 5,766,818; 5,747,215; 5,827,633; 5,853,944; 5,804,349; 5,840,462; 5,869,215; 5,869,215; 5,863,698; 5,902,710; 5,910,387; 5,916,725; 5,919,595; 5,925,488; 5,977,210; 5,994,020; 6,020,101; 6,130,021; 6,120,967 and 6,628,102.

The appropriate components and processes of the above Xerox Corporation patents can be selected for the toners and processes illustrated herein in embodiments thereof.

SUMMARY

It is a feature of the disclosure to provide toner processes with many of the advantages illustrated herein.

Another feature of the disclosure resides in the generation of toners with low melting characteristics and with excellent minimum fixing temperatures.

Further, another feature of the disclosure relates to toners generated from a plurality of latexes, and wherein each latex contains a dissimilar resin.

In another feature of the disclosure there are provided simple and economical processes for the preparation of black and colored toner compositions with excellent colorant dispersions, wherein the colorant particle size diameter is, for example, in the submicron of about 80 to about 200 nanometers, and the dispersion is stable over a period of, for example, about 30 days, thus enabling the achievement of excellent color print quality and providing similar toner charging behavior despite differential colorant chemistry.

Also, another feature of the disclosure resides in the preparation of chemical toners, from three dissimilar latex containing resins, with a coagulant of a polyamine salt, which salt primarily functions to initiate aggregation, and to which is added a second latex which forms a shell on the toner aggregates, followed by raising the pH of the aggregates mixture, which is of from about 2 to about 2.8, to a pH value of about 7 to about 9 to stabilize the aggregate particles preventing or minimizing further growth when the temperature of the aggregates mixture is raised above the resin Tg.

Aspects disclosed and illustrated herein and of the present invention in embodiments relate to a toner comprised of a mixture of a semicrystalline polymer, an amorphous polymer and a crystalline polyolefin; and a colorant; a process for the preparation of a toner comprised of the mixing of a polymer latex comprised of semicrystalline polymer, an amorphous polymer and a crystalline polyolefin and colorant, followed by heating below amorphous polymer Tg (glass transition) temperature, and then subsequently heating above the amorphous polymer Tg; a toner comprised of a plurality of resins, which plurality contains a semicrystalline polymer, an amorphous polymer and a polyolefin, and which toner further contains a colorant, optionally a wax and optionally toner additives; a process comprising the heating of latexes comprised of a first latex, a second latex, and a third latex wherein the first latex contains a semicrystalline polymer, the second latex contains an amorphous polymer, and the third latex contains a crystalline polyolefin and colorants; and wherein the heating comprises a first heating below about the Tg of the amorphous polymer, and a second subsequent heating above about the Tg of the amorphous polymer; a process comprising (i) generating or providing three latex emulsions containing three dissimilar resins, water, and an ionic surfactant, and generating or providing a colorant dispersion containing colorant, water, and an ionic surfactant, or a nonionic surfactant;

(ii) blending the latex emulsions with the colorant dispersion;

(iii) adding to the resulting blend a coagulant, such as a polymetal halide, polyamine salt of an acid wherein the salt is of an opposite charge polarity to that of the surfactant latex;

(iv) heating the resulting mixture below or about equal to the glass transition temperature (Tg) of the latex resin;

(v) optionally adding a second latex comprised of resin particles suspended in an aqueous phase resulting in a shell;

(vi) adjusting with a base the pH to about 7 to about 9;

(vii) heating the resulting mixture of (vi) above about the Tg of the latex resin;

(viii) retaining the heating until the fusion or coalescence of resin and colorant is initiated;

(ix) changing the pH of the above (viii) mixture with an acid to arrive at a pH of about 1.5 to about 3.5 to thereby accelerate the fusion or the coalescence, and resulting in toner particles comprised of resin and colorant; and (x) optionally isolating the toner; a process wherein there is added to the resulting blend the coagulant and wherein the coagulant is a polyamine salt of hydrochloric acid, or a polyamine salt of sulfuric acid;

followed by heating the resulting mixture below the glass transition temperature (Tg) of the latex resin to form toner sized aggregates of resin and colorant;

adding to the formed toner aggregates a second latex comprised of submicron resin particles suspended in an aqueous phase resulting in a resin shell on the aggregates, and wherein the shell is of an optional thickness of from about 0.1 to about 1 micron;

adjusting the pH of the resulting toner aggregate mixture with a base from an initial pH of about 1.9 to about 3 to a pH of about 7 to about 9;

heating the resulting aggregate suspension above the Tg of the latex resin;

retaining the mixture temperature at from about 70° C. to about 95° C. to initiate the fusion or coalescence of the toner aggregates;

changing the pH of the resulting mixture after about 0.5 to about 1.5 hours by the addition of an acid to arrive at a pH of about 1.7 to about 3 to thereby accelerate the fusion or said coalescence resulting in a toner comprised of resin and colorant; and isolating the toner; a process wherein the coagulant is a polyaluminum chloride, or an organic aliphatic amino ester selected from the group consisting of tri(2-aminoethyl) citrate, 2-aminoethyl ester, 3-aminopropyl ester, 4-aminobutyl ester, 4-aminobutyroate, 5-aminopentanoate, 6-aminocaproate, quaternary ammonium ester, tertiary aminoester, aminosulfonate, aminosulfonite, aminophosphorate, and aminophosphorite; a process wherein the base is a metal hydroxide selected from the group consisting of sodium hydroxide, potassium hydroxide, and ammonium hydroxide; a process wherein the acid is selected from the group consisting of nitric acid, sulfuric acid, hydrochloric acid, citric acid, and acetic acid; a process wherein the coagulant is selected in the amount of about 0.075 to about 5 percent by weight of the toner comprised of resin and colorant, and wherein the total of all solid toner components is about 100 percent; a process wherein there is added to the formed toner aggregates a fourth latex comprised of submicron resin particles suspended in an aqueous phase containing an ionic surfactant, and wherein the latex is selected in an amount of about 10 to about 40 percent by weight of the latexes (i) to thereby form a shell on the toner aggregates; a process wherein the added fourth latex contains the same resin as the initial latexes of (i), or wherein the added latex contains a dissimilar resin than that of the initial latexes (i); a process wherein (iv) is accomplished by heating at a temperature below about the glass transition temperature of the amorphous polymer selected from the group consisting of poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly (styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylononitrile-acrylic acid), and a mixture thereof; and which heating is from about 1° C. to about 30° C. below the glass transition temperature of the amorphous polymer to thereby form toner aggregates, and the coalescence (vii) is accomplished by heating at a temperature of above about the glass transition temperature of, for example, from about 5° C. to about 50° C. of the amorphous polymer; a process wherein the aggregation temperature is from about 40° C. to about 60° C., and the coalescence temperature is from about 75° C. to about 97° C.; a process wherein the temperature at which the aggregation is accomplished controls the size of the aggregates, and wherein the final toner size is from about 2 to about 20 microns in volume average diameter; a process wherein the pH of the mixture resulting in (v) is increased from an initial of about 2 to about 2.6 to a final of about 5 to about 8, and wherein said base functions primarily as a stabilizer for the aggregates during the coalescence, and no or minimal particle size or GSD increase; a process wherein the colorant is a pigment, and wherein the pigment is in the form of a dispersion, which dispersion contains an ionic surfactant, and wherein the coagulant functions to primarily enable aggregation of the latexes and the colorant; a process wherein at least one latex contains a resin selected from the group consisting of poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly (methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid), poly(styrene-butadiene-β-carboxyethyl acrylate), poly(styrene-butadiene-acrylonitrile-β-carboxyethyl acrylate), poly(styrene-butyl acrylate-β-carboxyethyl acrylate), and poly(styrene-butyl acrylate-acrylononitrile-β-carboxyethyl acrylate); and wherein the second latex resin is, for example, polyacetone, polycaprolactone, poly(N-docosyl acrylamide), poly(ethylene fumar amide), poly(adipic anhydride), poly(dodecapedioic anhydride), poly(3-methyl-1-butene), poly(hexamethylene carbonate), poly(ethyl vinyl ether), poly(propyl vinyl ether), poly(butyl vinyl ether), poly(vinyl butyral), poly(ethylene-p-carboxy phenoxy-butyrate), poly(ethylene-vinyl acetate), poly(docosyl acrylate), poly(dodecyl acrylate), poly(octadecyl acrylate), poly(octadecyl methacrylate), poly(behenylpolyethoxyethyl methacrylate), poly(ethylene adipate), poly(decamethylene adipate), poly(decamethylene azelaate), poly(hexamethylene oxalate), poly(decamethylene oxalate), poly(ethylene oxide), poly(propylene oxide), poly(butadiene oxide), poly (decamethylene oxide), poly(decamethylene sulfide), poly (decamethylene disulfide), poly(ethylene sebacate), poly (decamethylene sebacate), poly(ethylene suberate), poly (decamethylene succinate), poly(eicosamethylene malonate), poly(ethylene-p-carboxy phenoxy-undecanoate), poly(ethylene dithionesophthalate), poly(methyl ethylene terephthalate), poly(ethylene-p-carboxy phenoxy-valerate), poly(hexamethylene-4,4'-oxydibenzoate), poly(10-hydroxy capric acid), poly(isophthalaldehyde), poly(octamethylene dodecanedioate), poly(dimethyl siloxane), poly(dipropyl siloxane), poly(tetramethylene phenylene diacetate), poly (tetramethylene trithiodicarboxylate), poly(trimethylene dodecane dioate), poly(m-xylene), poly(p-xylylene pimelamide), and the third latex resin is wax, polyolefins, such as polyethylene, polypropylene, polypentene, polydecene, polydodecene, polytetradecene, polyhexadecene, polyoctadene, polycyclodecene, polyolefin copolymers, mixtures of polyolefins, bi-modal molecular weight polyolefins, functional polyolefins, acidic polyolefins, hydroxyl polyolefins, branched polyolefins, for example, such as those available from Sanyo Chemicals of Japan as VISCOL 550P™ and VISCOL 660P™, Mitsui "Hi-wax" NP055 and NP105, or wax blends, such as MicroPowders, Micropro-440 and 440w; a process wherein the colorant is carbon black, cyan, yellow, magenta, or mixtures thereof; the toner isolated is optionally from about 2 to about 15 microns in volume average diameter, and the particle size distribution thereof is optionally from about 1.15 to about 1.30; and wherein there is added to the surface of the formed toner metal salts, metal salts of fatty acids, silicas, metal oxides, or mixtures thereof, each in an amount of from about 0.1 to about 10 weight percent of the obtained toner; a toner process wherein there is permitted a suitable toner triboelectrical charge such as greater than about 20 $\mu$C/gram at 20 percent RH; a process wherein the temperature at which the aggregation is accomplished controls the size of the aggregates, and wherein the final toner size is from about 3 to about 18 microns in volume average diameter; a process wherein the aggregation temperature is from about 45° C. to about 55° C., and wherein the coalescence or fusion temperature is from about 85° C. to about 95° C.; a process wherein the coagulant is added during or prior to aggregation of the latex resin and colorant, and which coagulant enables or initiates the aggregation; a process wherein the colorant is carbon black, cyan, yellow, red, magenta, or mixtures thereof; a process wherein the toner isolated is from about 2 to about 25 microns in volume average diameter, and the particle size distribution (GSD) thereof is from about 1.15 to about 1.30, and wherein there is added to the surface of the formed toner additives, such as metal salts, metal salts of fatty acids, silicas, metal oxides, or mixtures thereof, each in an amount of from about 0.1 to about 10 weight percent of the obtained toner; a process wherein there is added to the formed toner aggregates a fourth latex in the amount of about 10 to about 40 percent by weight of the initial latexes, and more specifically, in an amount of about 15 to about 30 weight percent to form a shell on the latex; a process wherein the added latex comprises the same resin and molecular properties as the initial latex or a different composition and properties than that of the initial latex; a process wherein the aggregation is accomplished by heating at a temperature of below about the glass transition temperature of the amorphous polymer contained in the latex; a process wherein the coalescence is accomplished by heating at a temperature of above about the glass transition temperature of the amorphous polymer contained in the latex; a process wherein the aggregation temperature is from about 40° C. to about 62° C., and more specifically, is from about 45° C. to about 58° C.; a process wherein the coalescence temperature is from about 75° C. to about 95° C., and more specifically, about 85° C. to about 90° C.; a process wherein the amount of base selected is from about 0.5 to about 20 weight percent, and more specifically, is about 1 to about 10 weight percent; a process wherein the amount of metal hydroxide selected is from about 5 to about 15 weight percent; a process for the preparation of toner particles resulting in images with excellent print quality, wherein there are selected latexes more specifically comprised of submicron resin particles which are a diameter of about 0.05 to about 0.5 micron, and more specifically, about 0.07 to about 0.35 micron suspended in an aqueous water phase containing an ionic surfactant, which is selected in an amount of about 0.5 to about 5 percent, and preferably about 0.7 to about 2 percent by weight of solids, to which is added a colorant dispersion comprising submicron, for example less than, or equal to about 0.5 micron diameter, colorant particles, anionic or a nonionic surfactant which is selected in an amount of from about 0.5 to about 10 percent, and more specifically, from about 0.6 to about 5 percent by weight of solids, which when blended together result in a mixture with a pH of about 2 to about 2.6 to which a coagulant is added; further aggregating by stirring and heating from about 5 to about 10 degrees below the resin Tg, resulting in toner aggregates of a size of about 3 to about 15 microns, and preferably about 4 to about 8 microns with a narrow GSD in the range of, for example, about 1.14 to about 1.28 and preferably in the range of about 1.17 to about 1.25; followed by adjusting the pH of the mixture of from about 2 to about 2.6 to a pH of about 6 to about 9 and preferably to about 7 to about 8.5, and more preferably to a pH of about 8 with the addition of a dilute base solution of 4 weight percent of sodium hydroxide to primarily stabilize the aggregates; further stirring and increasing the mixture temperature above the resin Tg of about 70° C. to about 95° C., and more specifically, of about 85° C. to about 93° C. for a period of about 0.5 to about 1.5 hours, followed by changing the pH from about 8 to about 3 by the use of an acid, such as dilute nitric acid, wherein the concentration of acid is about 0.5 to about 10 weight percent, and more specifically, about 0.75 to about 5 weight percent, and heating the mixture for an additional about 0.5 to about 4 hours, and more specifically, from about 0.6 to about 3 hours to fuse or coalesce the aggregates, and then washing and drying the toner; a process wherein the use of an oxidizing agent allows the pH of the mixture to be reduced below a pH of 3 enabling rapid spheroidization; processes for the preparation of toner compositions which comprise blending an aqueous colorant dispersion preferably containing a pigment, such as carbon black, phthalocyanine, quinacridone or RHODAMINE B™ type, red, green, orange, brown, violet, yellow, fluorescent colorants and the like, with a latex emulsion derived from the emulsion polymerization of three latex monomers one of which is selected, for example, from the group consisting of styrene, butadiene, acrylates, methacrylates, acrylonitrile, acrylic acid, methacrylic acid, itaconic or beta carboxy ethyl acrylate (β CEA), and the like, and which latex contains an ionic surfactant, such as sodium dodecylbenzene sulfonate, and optionally a nonionic surfactant, and which process is accomplished in the presence of a polyaluminum chloride or a metal salt; and a process wherein the particle size of the toner provided in embodiments can be controlled, for example, by the temperature at which the aggregation of latex, colorant, such as pigment and optional additives, is conducted. In general, the lower the aggregation temperature, the smaller the aggregate size, and thus the final toner size.

Examples of first semicrystalline resins with a crystalline percentage of, for example, from about 10 to about 60, and more specifically, from about 12 to about 50 percent, and which resin possesses a melting point of, for example, from about 50° C. to about 110° C., and more specifically, from about 55° C. to about 90° C., are polyacetone, polycaprolactone, poly(N-docosyl acrylamide), poly(ethylene fumar amide), poly(adipic anhydride), poly(dodecapedioic anhydride), poly(3-methyl-1-butene), poly(hexamethylene carbonate), poly(ethyl vinyl ether), poly(propyl vinyl ether), poly(butyl vinyl ether), poly(vinyl butyral), poly(ethylene-p-carboxy phenoxy-butyrate), poly(ethylene-vinyl acetate), poly(docosyl acrylate), poly(dodecyl acrylate), poly(octadecyl acrylate), poly(octadecyl methacrylate), poly(behenylpolyethoxyethyl methacrylate), poly(ethylene adipate), poly(decamethylene adipate), poly(decamethylene azelaate), poly(hexamethylene oxalate), poly(decamethylene oxalate), poly(ethylene oxide), poly(propylene oxide), poly (butadiene oxide), poly(decamethylene oxide), poly(decamethylene sulfide), poly(decamethylene disulfide), poly(ethylene sebacate), poly(decamethylene sebacate), poly (ethylene suberate), poly(decamethylene succinate), poly (eicosamethylene malonate), poly(ethylene-p-carboxy phenoxy-undecanoate), poly(ethylene dithionesophthalate), poly(methyl ethylene terephthalate), poly(ethylene-p-carboxy phenoxy-valerate), poly(hexamethylene-4,4'-oxydibenzoate), poly(10-hydroxy capric acid), poly(isophthaladehyde), poly(octamethylene dodecanedioate), poly (dimethyl siloxane), poly(dipropyl siloxane), poly (tetramethylene phenylene diacetate), poly(tetramethylene trithiodicarboxylate), poly(trimethylene dodecane dioate), poly(m-xylene), and poly(p-xylylene pimelamide). The semicrystalline resin possesses, for example, a suitable weight average molecular weight $M_w$, such as from about 7,000 to about 200,000, and more specifically from about 10,000 to about 150,000, a number average molecular weight $M_n$ of, for example, from about 1,000 to about 60,000, and more specifically, from about 3,000 to about 50,000.

Examples of the second amorphous resins with a glass transition temperature of, for example, from about 40° C. to about 80° C., and more specifically, from about 48° C. to about 60° C., are poly(styrene-butadiene), poly(methylstyrene-butadiene), poly(methyl methacrylate-butadiene), poly (ethyl methacrylate-butadiene), poly(propyl methacrylate-butadiene), poly(butyl methacrylate-butadiene), poly (methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylononitrile-acrylic acid), poly(styrene-butadiene-β-carboxyethyl acrylate), poly(styrene-butadiene-acrylonitrile-β-carboxyethyl acrylate), poly(styrene-butyl acrylate-β-carboxyethyl acrylate), and poly(styrene-butyl acrylate-acrylononitrile-β-carboxyethyl acrylate). The amorphous resin possesses a weight average molecular weight $M_w$ of, for example, from about 20,000 to about 55,000, and more specifically, from about 25,000 to about 45,000, a number average molecular weight $M_n$ of, for example, from about 5,000 to about 18,000, and more specifically, from about 6,000 to about 15,000.

Examples of the third high crystalline polyolefins resins are polyethylene, polypropylenes and generally polyolefins; copolymers thereof; copolymers thereof containing functional groups such as carboxyl groups, hydroxyl groups, and the like. The $M_n$ of the high crystalline polymer is, for example, from about 400 to about 4,500, and preferably from about 500 to about 3,000. The $M_w$ of high crystalline polymer is, for example, from about 500 to about 5,000, and preferably from about 600 to about 3,500.

One latex can also contain a resin, or polymer, such as a known polymer such as poly(styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly (propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-butylacrylate), poly(styrene-butadiene), poly(styrene-isoprene), poly(styrene-butyl methacrylate), poly(styrene-butyl acrylate-acrylic acid), poly(styrene-butadiene-acrylic acid), poly(styrene-isoprene-acrylic acid), poly(styrene-butyl methacrylate-acrylic acid), poly(butyl methacrylate-butyl acrylate), poly(butyl methacrylate-acrylic acid), poly(styrene-butyl acrylate-acrylonitrile-acrylic acid), poly(acrylonitrile-butyl acrylate-acrylic acid), poly(styrene-butadiene-β-carboxyethyl acrylate), poly(styrene-butadiene-acrylonitrile-β-carboxyethyl acrylate), poly(styrene-butyl acrylate-β-carboxyethyl acrylate), and poly(styrene-butyl acrylate-acrylononitrile-β-carboxyethyl acrylate), and the like. The latex polymer, or resin is generally present in the toner compositions in various suitable amounts, such as from about 75 weight percent to about 98, or from about 80 to about 95 weight percent of the toner or of the solids, and the latex size suitable can be, for example, preferably from about 0.05 micron to about 0.5 micron in volume average diameter as measured by the Brookhaven nanosize particle analyzer. Other sizes and effective amounts of latex polymer may be selected in embodiments. The total of all toner components, such as resin and colorant, is about 100 percent, or about 100 parts.

The polymers selected, which are available from various sources, can be prepared by emulsion polymerization methods, and which polymers are, for example, polyethylene, polypropylene, a copolymer of polyethylene and polypropylene containing functional groups such as carboxyl or hydroxyl groups, styrene, acrylates, methacrylates, butadiene, isoprene, acrylic acid, methacrylic acid, itaconic acid, beta carboxy ethyl acrylate, acrylonitrile, and the like. Known chain transfer agents, for example dodecanethiol, from, for example, about 0.1 to about 10 percent, or carbon tetrabromide in effective amounts, such as for example from about 0.1 to about 10 percent, can also be utilized to control the molecular weight properties of the polymer when emulsion polymerization is selected. Other processes of obtaining polymer particles of from, for example, about 0.01 micron to about 2 microns can be selected from polymer microsuspension process, such as disclosed in U.S. Pat. No. 3,674,736, the disclosure of which is totally incorporated herein by reference; polymer solution microsuspension process, such as disclosed in U.S. Pat. No. 5,290,654, the disclosure of which is totally incorporated herein by reference; mechanical grinding processes, or other known processes.

Examples of waxes include those as illustrated herein, such as those of the aforementioned copending applications, polypropylenes and polyethylenes commercially available from Allied Chemical and Petrolite Corporation, wax emulsions available from Michaelman Inc. and the Daniels Products Company, EPOLENE N-15™ commercially available from Eastman Chemical Products, Inc., VISCOL 550-P™, a low weight average molecular weight polypropylene available from Sanyo Kasei K. K., and similar materials. The commercially available polyethylenes selected have a molecular weight of from about 1,000 to about 1,500, while the commercially available polypropylenes are believed to have a molecular weight of from about 4,000 to about 5,000. Examples of functionalized waxes include, such as amines, amides, for example aqua SUPERSLIP 6550™, SUPERSLIP 6530™ available from Micro Powder Inc., fluorinated waxes, for example POLYFLUO 190™, POLYFLUO 200™, POLYFLUO 523XF™, AQUA POLYFLUO 411™, AQUA POLYSILK 19™, POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL™ 74, 89, 130, 537, and 538, all available from SC Johnson Wax, chlorinated polypropylenes and polyethylenes commercially available from Allied Chemical and Petrolite Corporation and SC Johnson wax.

Various known colorants, such as pigments, selected for the processes illustrated herein and present in the toner in an effective amount of, for example, from about 1 to about 25 percent by weight of toner, and preferably in an amount of from about 3 to about 10 percent by weight, that can be selected include, for example, carbon black like REGAL 330®. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E. I. DuPont de Nemours & Company, and the like. Generally, colored pigments that can be selected are cyan, magenta, or yellow pigments, and mixtures thereof. Examples of magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans that may be selected include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, Yellow 180 and Permanent Yellow FGL components may also be selected as pigments with the process of the present invention, wherein the pigment is in the range of 3 to 15 weight percent of the toner. Dye examples include known suitable dyes, reference the Color Index, and a number of U.S. patents, such as food dyes, and the like.

Colorants include pigment, dye, mixtures of pigment and dyes, mixtures of pigments, mixtures of dyes, and the like.

Examples of initiators for the latex preparations include water soluble initiators, such as ammonium and potassium persulfates, in suitable amounts, such as from about 0.1 to about 8 percent, and preferably in the range of from about 0.2 to about 5 percent (weight percent). Examples of organic soluble initiators include Vazo peroxides, such as VAZO 64™, 2-methyl 2-2'-azobis propanenitrile, VAZO 88™, 2-2'-azobis isobutyramide dehydrate in a suitable amount, such as in the range of from about 0.1 to about 8 percent. Examples of chain transfer agents include dodecane thiol, octane thiol, carbon tetrabromide and the like in various suitable amounts, such as in the range amount of from about 0.1 to about 10 percent and preferably in the range of from about 0.2 to about 5 percent by weight of monomer.

Surfactants for the preparation of latexes and colorant dispersions can be ionic or nonionic surfactants in present effective amounts of, for example, from about 0.01 to about 15, or from about 0.01 to about 5 weight percent of the reaction mixture. Anionic surfactants include sodium dodecylsulfate (SDS), sodium dodecylbenzene sulfonate, sodium dodecyinaphthalene sulfate, dialkyl benzenealkyl, sulfates and sulfonates, abitic acid, available from Aldrich, NEOGEN R™, NEOGEN SC™ obtained from Kao, and the like.

Examples of nonionic surfactants selected in various suitable amounts, such as about 0.1 to about 5 weight percent, are polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™ can be selected.

The toner may also include known charge additives in effective suitable amounts of, for example, from 0.1 to about 5 weight percent, such as alkyl pyridinium halides, bisulfates, the charge control additives of U.S. Pat. Nos. 3,944,493; 4,007,293; 4,079,014; 4,394,430 and 4,560,635, the disclosures of which are totally incorporated herein by reference, negative charge enhancing additives like aluminum complexes, other known charge additives, and the like.

Surface additives that can be added to the toner compositions after washing or drying include, for example, metal salts, metal salts of fatty acids, colloidal silicas, metal oxides, strontium titanates, mixtures thereof, and the like, which additives are each usually present in an amount of from about 0.1 to about 2 weight percent, reference for example U.S. Pat. Nos. 3,590,000; 3,720,617; 3,655,374 and 3,983,045, the disclosures of which are totally incorporated herein by reference. Preferred additives include zinc stearate and AEROSIL R972® available from Degussa. The coated silicas of U.S. Pat. No. 6,190,815 and U.S. Pat. No. 6,004,714, the disclosures of which are totally incorporated herein by reference, can also be selected in amounts, for example, of from about 0.1 to about 2 percent, which additives can be added during the aggregation or blended into the formed toner product.

Developer compositions can be prepared by mixing the toners obtained with the processes disclosed herein with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration. The carrier particles can also be comprised of a core with a polymer coating thereover, such as polymethylmethacrylate (PMMA), having dispersed therein a conductive component like conductive carbon black. Carrier coatings include silicone resins, fluoropolymers, mixtures of resins not in close proximity in the triboelectric series, thermosetting resins, and other known components.

Imaging methods are also envisioned with the toners disclosed herein, reference for example a number of the patents mentioned herein, and U.S. Pat. Nos. 4,265,990; 4,858,884; 4,584,253 and 4,563,408, the disclosures of which are totally incorporated herein by reference.

The following Examples and Comparative Examples are provided.

POLYMER DISPERSION PREPARATION

DISPERSION EXAMPLE I

Polycaprolactone Polymer Dispersion:

An aqueous polycaprolactone polymer dispersion containing semicrystalline polycaprolactone particles and a surfactant in water is generated using a homogenization process. 300 Grams of a semicrystalline polycaprolactone powder (TONE® Polymer LPS-60HP, crystallinity of 30 percent, $M_w$ of 12,000, available from Union Carbide), 218.8 grams of a surfactant aqueous solution containing 27 grams of the anionic surfactant NEOGEN RK™ (sodium dodecylbenzene sulfonate, Kao, Japan), and 981 grams of deionized water are dispensed into a beaker and stirred with the aid of a mechanical stirrer. The resultant polymer mixture is predispersed for about 5 minutes using an IKA ULTRA TURRAX® T50 homogenizer (IKA Labortechnik, Germany) operating at a speed starting at about 4,000 revolutions per minute and ending at about 7,000 revolutions per minute. The resulting predispersed polymer mixture is then poured into the feed hopper of a Rannie Lab 2000 homogenizer (APV Homogenizer Group, USA). The homogenizer is activated to pump the polymer mixture through the homogenizer at a rate of about 11 liters per hour. The product is collected in a product container wherein the container is cooled by means of an ice bath. Initially, the homogenizer primary and secondary valves are kept fully open. When the mixture is being pumped steadily through the homogenizer, the homogenizer primary valve is closed to increase the pressure drop in the valve to about 50 megapascals. When the feed hopper is nearly empty, the homogenized product in the product container is poured back into the feed hopper, and the homogenizer primary valve is further closed to increase the pressure drop in the valve to about 100 megapascals. When the feed hopper is nearly empty, the homogenized product in the product container is poured back into the feed hopper, and the homogenizer primary valve is further closed to increase the pressure drop in the valve to a final set point of about 150 megapascals. The mixture is then pumped through the homogenizer 28 times at a pressure of 150 megapascals. At the completion of homogenization, the homogenizer primary valve is opened and the homogenizer is disengaged.

The product is comprised of a surfactant stabilized polymer dispersion comprising 20.5 weight percent of the semicrystalline polycaprolactone, 1.85 weight percent of NEOGEN RK™ surfactant, and 77.65 weight percent of water. The polycaprolactone polymer particles of the dispersion have a volume median diameter of 312 nanometers as measured by light scattering technique on a Coulter N4 Plus Particle Sizer.

DISPERSION EXAMPLE II

Poly(ethylene-vinyl acetate) Polymer Dispersion:

An aqueous poly(ethylene-vinyl acetate) polymer dispersion containing semicrystalline poly(ethylene-vinyl acetate) particles and a surfactant in water is produced using the homogenization process. 300 Grams of a semicrystalline poly(ethylene-vinyl acetate) powder (ethylene to vinyl acetate ratio of 75:25, crystallinity of 33 percent, $M_w$ of 100,000, available from Aldrich Chemicals), 218.8 grams of a surfactant aqueous solution containing 27 grams of anionic surfactant NEOGEN RK™, and 981 grams of deionized water are dispensed into a beaker and stirred with the aid of a mechanical stirrer. The resultant polymer mixture is predispersed for about 5 minutes using an IKA ULTRA TURRAX® T50 homogenizer (IKA Labortechnik, Germany) operating at a speed starting at about 4,000 revolutions per minute and ending at about 7,000 revolutions per minute. The resulting predispersed polymer mixture is then poured into the feed hopper of a Rannie Lab 2000 homogenizer (APV Homogenizer Group, USA). The homogenizer is turned on to pump the polymer mixture through the homogenizer at a rate of about 11 liters per hour. The product is collected in a product container wherein the container is cooled by means of an ice bath. Initially, the homogenizer primary and secondary valves are kept fully open. When the pigment mixture is being pumped steadily through the homogenizer, the homogenizer primary valve is closed to increase the pressure drop in the valve to about 50 megapascals. When the feed hopper is nearly empty, the homogenized product in the product container is poured back into the feed hopper, and the homogenizer primary valve is further closed to increase the pressure drop in the valve to about 100 megapascals. When the feed hopper is nearly empty, the homogenized product in the product container is poured back into the feed hopper, and the homogenizer primary valve is further closed to increase the pressure drop in the valve to a final set point of about 150 megapascals. The mixture is then pumped through the homogenizer 28 times at a pressure of 150 megapascals. At the completion of homogenization, the homogenizer primary valve is opened and the homogenizer is disengaged.

The product is comprised of a surfactant stabilized polymer dispersion comprising 20.5 weight percent of the above semicrystalline poly(ethylene-vinyl acetate), 1.85 weight percent of NEOGEN RK™ surfactant, and 77.65 weight percent of water. The poly(ethylene-vinyl acetate) polymer particles of the dispersion have a volume median diameter of 345 as measured by light scattering technique on a Coulter N4 Plus Particle Sizer.

DISPERSION EXAMPLE III

Poly(vinyl butyral) Polymer Dispersion:

An aqueous poly(vinyl butyral) polymer dispersion containing semicrystalline poly(vinyl butyral) particles and a surfactant in water is produced using the homogenization process. 300 Grams of a semicrystalline poly(vinyl butyral) powder (BUTVAR® B-79, crystallinity of 25 percent, $M_w$ of 65,000, available from Solutia Inc.), 218.8 grams of a surfactant aqueous solution containing 27 grams of anionic surfactant NEOGEN RK™, and 981 grams of deionized water are dispensed into a beaker and stirred with the aid of a mechanical stirrer. The resultant polymer mixture is predispersed for about 5 minutes using an IKA ULTRA TURRAX® T50 homogenizer (IKA Labortechnik, Germany) operating at a speed starting at about 4,000 revolutions per minute and ending at about 7,000 revolutions per minute. The resulting predispersed polymer mixture is then poured into the feed hopper of a Rannie Lab 2000 homogenizer (APV Homogenizer Group, USA). The homogenizer is turned on to pump the polymer mixture through the homogenizer at a rate of about 11 liters per hour. The product is collected in a product container wherein the container is cooled by means of an ice bath. Initially, the homogenizer primary and secondary valves are kept fully open. When the mixture is being pumped steadily through the homogenizer, the homogenizer primary valve is closed to increase the pressure drop in the valve to about 50 megapascals. When the feed hopper is nearly empty, the homogenized product in the product container is poured back into the feed hopper, and the homogenizer primary valve is further closed to increase the pressure drop in the valve to about 100 megapascals. When the feed hopper is nearly empty, the homogenized product in the product container is poured back into the feed hopper, and the homogenizer primary valve is further closed to increase the pressure drop in the valve to a final set point of about 150 megapascals. The mixture is then pumped through the homogenizer 28 times at a pressure of 150 megapascals. At the completion of homogenization, the homogenizer primary valve is opened and the homogenizer is disengaged.

The product is comprised of a surfactant stabilized polymer dispersion comprising 20.5 weight percent of the semicrystalline poly(vinyl butyral), 1.85 weight percent of NEOGEN RK™ surfactant, and 77.65 weight percent of water. The poly(vinyl butyral) polymer particles of the dispersion have a volume median diameter of 407 as measured by light scattering technique on a Coulter N4 Plus Particle Sizer.

DISPERSION EXAMPLE IV

Poly(ethylene oxide) Polymer Dispersion:

An aqueous poly(ethylene oxide) polymer dispersion containing semicrystalline poly(ethylene oxide) particles and a surfactant in water is produced using the homogenization process. 300 Grams of a semicrystalline poly(ethylene oxide) powder (crystallinity of 35 percent, $M_w$ of 100,000, available from Aldrich Chemicals), 218.8 grams of a surfactant aqueous solution containing 27 grams of anionic surfactant NEOGEN RK™, and 981 grams of deionized water are dispensed into a beaker and stirred with the aid of a mechanical stirrer. The resultant polymer mixture is predispersed for about 5 minutes using an IKA ULTRA TURRAX® T50 homogenizer (IKA Labortechnik, Germany) operating at a speed starting at about 4,000 revolutions per minute and ending at about 7,000 revolutions per minute. The resulting predispersed polymer mixture is then poured into the feed hopper of a Rannie Lab 2000 homogenizer (APV Homogenizer Group, USA). The homogenizer is turned on to pump the polymer mixture through the homogenizer at a rate of about 11 liters per hour. The product is collected in a product container wherein the container is cooled by means of an ice bath. Initially, the homogenizer primary and secondary valves are kept fully open. When the mixture is being pumped steadily through the homogenizer, the homogenizer primary valve is closed to increase the pressure drop in the valve to about 50 megapascals. When the feed hopper is nearly empty, the homogenized product in the product container is poured back into the feed hopper, and the homogenizer primary valve is further closed to increase the pressure drop in the valve to about 100 megapascals. When the feed hopper is nearly empty, the homogenized product in the product container is poured back into the feed hopper, and the homogenizer primary valve is further closed to increase the pressure drop in the valve to a final set point of about 150 megapascals. The mixture is then pumped through the homogenizer 28 times at a pressure of 150 megapascals. At the completion of homogenization, the homogenizer primary valve is opened and the homogenizer is disengaged.

The product is comprised of a surfactant stabilized polymer dispersion comprising 20.5 weight percent of the semicrystalline poly(ethylene oxide), 1.85 weight percent of NEOGEN RK™ surfactant, and 77.65 weight percent of water. The poly(ethylene oxide) polymer particles of the dispersion have a volume median diameter of 258 as measured by light scattering technique on a Coulter N4 Plus Particle Sizer.

DISPERSION EXAMPLE V

Poly(behenylpolyethoxyethyl methacrylate) Polymer Dispersion:

An aqueous poly(behenylpolyethoxyethyl methacrylate) polymer dispersion containing a semicrystalline poly(behenylpolyethoxyethyl methacrylate) particles and a surfactant in water is produced using the homogenization process. 300 Grams of a semicrystalline poly(behenylpolyethoxyethyl methacrylate) powder (crystallinity of 25 percent, $M_w$ of 46,000, available from Rhone-Poulenc), 218.8 grams of a surfactant aqueous solution containing 27 grams of anionic surfactant NEOGEN RK™, and 981 grams of deionized water are dispensed into a beaker and stirred with the aid of a mechanical stirrer. The resultant polymer mixture is predispersed for about 5 minutes using an IKA ULTRA TURRAX® T50 homogenizer (IKA Labortechnik, Germany) operating at a speed starting at about 4,000 revolutions per minute and ending at about 7,000 revolutions per minute. The resulting predispersed polymer mixture is then poured into the feed hopper of a Rannie Lab 2000 homogenizer (APV Homogenizer Group, USA). The homogenizer is turned on to pump the polymer mixture through the homogenizer at a rate of about 11 liters per hour. The product is collected in a product container wherein the container is cooled by means of an ice bath. Initially, the homogenizer primary and secondary valves are kept fully open. When the mixture is being pumped steadily through the homogenizer, the homogenizer primary valve is closed to increase the pressure drop in the valve to about 50 megapascals. When the feed hopper is nearly empty, the homogenized product in the product container is poured back into the feed hopper, and the homogenizer primary valve is further closed to increase the pressure drop in the valve to about 100 megapascals. When the feed hopper is nearly empty, the homogenized product in the product container is poured back into the feed hopper, and the homogenizer primary valve is further closed to increase the pressure drop in the valve to a final set point of about 150 megapascals. The mixture is then pumped through the homogenizer 28 times at a pressure of 150 megapascals. At the completion of homogenization, the homogenizer primary valve is opened and the homogenizer is disengaged.

The product is comprised of a surfactant stabilized polymer dispersion comprising 20.4 weight percent of the semicrystalline poly(behenylpolyethoxyethyl methacrylate), 1.85 weight percent of NEOGEN RK™ surfactant, and 77.75 weight percent of water. The poly(behenylpolyethoxyethyl methacrylate) polymer particles of the dispersion have a volume median diameter of 296 nanometers as measured by light scattering technique on a Coulter N4 Plus Particle Sizer.

DISPERSION EXAMPLE VI

Poly(octadecyl acrylate) Polymer Dispersion:

An aqueous poly(octadecyl acrylate) polymer dispersion containing semicrystalline poly(octadecyl acrylate) particles, and a surfactant in water is produced using the homogenization process. 300 Grams of a semicrystalline poly(octadecyl acrylate) powder (crystallinity of 22 percent, $M_w$ of 65,000, available from Scientific Polymer Products), 218.8 grams of a surfactant aqueous solution containing 27 grams of anionic surfactant NEOGEN RK™, and 981 grams of deionized water are dispensed into a beaker and stirred with the aid of a mechanical stirrer. The resultant polymer mixture is predispersed for about 5 minutes using an IKA ULTRA TURRAX® T50 homogenizer (IKA Labortechnik, Germany) operating at a speed starting at about 4,000 revolutions per minute and ending at about 7,000 revolutions per minute. The resulting predispersed polymer mixture is then poured into the feed hopper of a Rannie Lab 2000 homogenizer (APV Homogenizer Group, USA). The homogenizer is turned on to pump the polymer mixture through the homogenizer at a rate of about 11 liters per hour. The product is collected in a product container wherein the container is cooled by means of an ice bath. Initially, the homogenizer primary and secondary valves are kept fully open. When the mixture is being pumped steadily through the homogenizer, the homogenizer primary valve is closed to increase the pressure drop in the valve to about 50 megapascals. When the feed hopper is nearly empty, the homogenized product in the product container is poured back into the feed hopper, and the homogenizer primary valve is further closed to increase the pressure drop in the valve to about 100 megapascals. When the feed hopper is nearly empty, the homogenized product in the product container is poured back into the feed hopper, and the homogenizer primary valve is further closed to increase the pressure drop in the valve to a final set point of about 150 megapascals. The mixture is then pumped through the homogenizer 28 times at a pressure of 150 megapascals. At the completion of homogenization, the homogenizer primary valve is opened and the homogenizer is disengaged.

The product is comprised of a surfactant stabilized polymer dispersion comprising 20.5 weight percent of semicrystalline poly(octadecyl acrylate), 1.85 weight percent of NEOGEN RK™ surfactant, and 77.65 weight percent of water. The poly(octadecyl acrylate) polymer particles of the dispersion have a volume median diameter of 272 nanometers as measured by light scattering technique on a Coulter N4 Plus Particle Sizer.

Polymer Latex Synthesis

LATEX EXAMPLE I

Poly(styrene-butyl acrylate-acrylic acid-β-carboxyethyl acrylate) Polymer Latex:

An amorphous polymer latex (EP306) comprised of a styrene/n-butyl acrylate/β-carboxyethyl acrylate copolymer of 74:23:3 was prepared with 1.7 pph dodecanethiol (chain transfer agent), 0.35 pph branching agent (A-DOD, decanediol diacrylate, available from Shin-Najamura Co., Japan), and 1.5 percent of ammonium persulfate initiator was synthesized by a semicontinuous emulsion polymerization process using the anionic surfactant DOWFAX 2A1™ (sodium tetrapropyl diphenoxide disulfonate, 47 percent active, available from Dow Chemical).

In a 300 gallon jacketed stainless steel reactor with double flight impellers (a four pitched-blade impeller each) set at 35 rpm, 387 kilograms of deionized water with 521 grams of DOWFAX 2A1™ (7 percent of the total surfactant) were charged while the temperature was raised from room, about 23° C. to about 25° C., temperature to 75° C. A monomer emulsion was prepared by mixing a monomer mixture (310.8 kilograms of styrene, 96.6 kilograms of n-butyl acrylate, 12.2 kilograms of 2-carboxyethyl acrylate (β-CEA), 1.43 kilograms of A-DOD and 4.5 kilograms of 1-dodecanethiol with 193 kilograms of deionized water and 8.07 kilograms of DOWFAX 2A1™ (93 percent of the total surfactant) at room temperature for 30 minutes in a 150 gallon Pope tank. 6.3 Kilograms of the seed were pumped from the monomer emulsion into a 20 gallon Pope tank, and subsequently the seed was charged into the reactor at 75° C. An initiator solution prepared from 6.1 kilograms of ammonium persulfate in 30.2 kilograms of deionized water was added over 20 minutes after the seed emulsion addition. The reactor was stirred at 48 rpm for an additional 20 minutes to allow seed particle formation at 75° C. The monomer emulsion was then fed into the reactor. Monomer emulsion feeding was stopped after 110 minutes and 2.49 kilograms of 1-dodecanethiol (DDT) were added to the remaining emulsion in the 150 gallon Pope tank which was mixed for a further 5 minutes before feeding resumed. The remaining monomer emulsion was fed into the reactor over 90 minutes. At the end of the monomer feed, the emulsion was post-heated at 75° C. for 180 minutes, then cooled to 25° C. The reaction system was deoxygenated by passing a stream of nitrogen through it during the reaction. A latex resin containing 42 solids of 42 weight percent styrene-butyl acrylate-β-carboxy ethylacrylate resin, 57 weight percent water, 0.4 weight percent anionic surfactant DOWFAX 2A1™, 0.6 percent of an ammonium sulfate salt species was obtained. The resulting amorphous polymer poly(styrene-butyl acrylate-acrylic acid-β-carboxyethyl acrylate) possessed a weight average molecular weight $M_w$ of 33,200, and a number average molecular weight $M_n$ of 10,400, as determined on a Waters GPC, and a mid-point Tg of 50.7° C., as measured on a Seiko DSC. The latex resin or polymer possessed a volume average diameter of 222 nanometers as measured by light scattering technique on a Coulter N4 Plus Particle Sizer.

LATEX EXAMPLE II

Polycaprolactone Containing Polymer Latex:

A polycaprolactone containing polymer latex comprised of a semicrystalline polycaprolactone polymer and an amorphous styrene/n-butyl acrylate/2-carboxyethyl acrylate terpolymer was synthesized by a semicontinuous, miniemulsion polymerization process. 1-Dodecanethiol with a solubility in water of $3\times10^{-5}$ grams per liter of water at 25° C. was used as a cosurfactant and as a primary chain transfer agent. In a 2 liter jacketed glass reactor with a stirrer set at 300 rpm, 5.3 grams of DOWFAX 2A1™ (sodium tetrapropyl diphenyloxide disulfonate, 47 percent active, Dow Chemical), and 370 grams of deionized water were deaerated for 30 minutes while the temperature was raised to 80° C. A miniemulsion was prepared by homogenizing a monomer-polymer mixture (290 grams of styrene, 97 grams of n-butyl acrylate, 23.2 grams of 2-carboxyethyl acrylate, 15.5 grams of 1-dodecanethiol, and 33.5 grams of polycaprolactone (TONE® Polymer LPS-60HP, crystallinity of 30 percent, $M_w$ of 12,000, available from Union Carbide)) with an aqueous solution of 1.3 grams of DOWFAX 2A1™, 3.9 grams of ammonium persulfate, and 224 grams of deionized water via VirTishear Cyclone Homogenizer at 10,000 rpm for 30 minutes at room temperature, about 25° C. throughout. The resulting miniemulsion was fed into the above reactor over a period of 105 minutes. At the conclusion of the monomer feed, the emulsion was post-heated at 80° C. for 30 minutes, then there was added an initiator aqueous solution of 1.9 grams of ammonium persulfate and 20 grams of deionized water. After the above initiator addition was completed, the reaction was allowed to post react for 90 minutes at 80° C., then cooled to 25° C. The resulting polycaprolactone containing polymer latex contained 42 percent solids comprised of amorphous poly(styrene-butyl acrylate-2-carboxyethyl acrylate) and semicrystalline polycaprolactone, and possessed an average particle size of 295 nanometers as measured by light scattering technique on a Coulter N4 Plus Particle Sizer, and more specifically, the resulting product was comprised of about 92.4 percent of an amorphous polymer of poly(styrene-butyl acrylate-2-carboxyethyl acrylate), and a semicrystalline polycaprolactone, about 7.6 percent by weight. The amorphous poly(styrene-butyl acrylate-2-carboxyethyl acrylate) polymer possessed an $M_w$ of 36,000, an $M_n$ of 9,200, both as determined on a Waters GPC, and a mid-point Tg of 51.6° C., as measured on a Seiko DSC.

LATEX EXAMPLE III

Poly(ethylene-vinyl acetate) Containing Polymer Latex:

A poly(ethylene-vinyl acetate) containing polymer latex comprised of a semicrystalline poly(ethylene-vinyl acetate) polymer and an amorphous styrene/n-butyl acrylate/2-carboxyethyl acrylate terpolymer was synthesized by a semicontinuous, miniemulsion polymerization process. 1-Dodecanethiol with a solubility in water of $3\times10^{-5}$ grams per liter of water at 25° C. was used as a cosurfactant and as a primary chain transfer agent. In a 2 liter jacketed glass reactor with a stirrer set at 300 rpm, 5.3 grams of DOWFAX 2A1™ (sodium tetrapropyl diphenyloxide disulfonate, 47 percent active, Dow Chemical), and 370 grams of deionized water were deaerated for 30 minutes while the temperature was raised to 80° C. A miniemulsion was prepared by homogenizing a monomer-polymer mixture (290 grams of styrene, 97 grams of n-butyl acrylate, 23.2 grams of 2-carboxyethyl acrylate, 15.5 grams of 1-dodecanethiol, and 33.5 grams of poly(ethylene-vinyl acetate) (ethylene to vinyl acetate ratio of 75:25, crystallinity of 33 percent, $M_w$ of 100,000, available from Aldrich Chemicals) with an aqueous solution of 1.3 grams of DOWFAX 2A1™, 3.9 grams of ammonium persulfate, and 224 grams of deionized water via VirTishear Cyclone Homogenizer at 10,000 rpm for 30 minutes at room temperature, about 25° C. throughout. The resulting miniemulsion was fed into the above reactor over a period of 105 minutes. At the conclusion of the monomer feed, the emulsion was post-heated at 80° C. for 30 minutes, then there was added an initiator aqueous solution of 1.9 grams of ammonium persulfate and 20 grams of deionized water. After the above initiator addition was completed, the reaction was allowed to post react for 90 minutes at 80° C., then cooled to 25° C. The resulting poly(ethylene-vinyl acetate) containing polymer latex contained 42 percent solids comprised of the amorphous poly(styrene-butyl acrylate-2-carboxyethyl acrylate) and the semicrystalline poly (ethylene-vinyl acetate), and possessed an average particle size of 312 nanometers as measured by light scattering technique on a Coulter N4 Plus Particle Sizer, and more specifically, the resulting product was comprised of about 92.4 percent of amorphous polymer of poly(styrene-butyl acrylate-2-carboxyethyl acrylate), and the semicrystalline poly(ethylene-vinyl acetate), about 7.6 percent by weight. The amorphous poly(styrene-butyl acrylate-2-carboxyethyl acrylate) polymer possessed an $M_w$ of 35,200, an $M_n$ of 8,900, both as determined on a Waters GPC, and a mid-point Tg of 51.4° C., as measured on a Seiko DSC.

LATEX EXAMPLE IV

Poly(vinyl butyral) Containing Polymer Latex:

A poly(vinyl butyral) containing polymer latex comprised of a semicrystalline poly(vinyl butyral) polymer and an amorphous styrene/n-butyl acrylate/2-carboxyethyl acrylate terpolymer was synthesized by a semicontinuous, miniemulsion polymerization process. 1-Dodecanethiol with a solubility in water of $3\times10^{-5}$ grams per liter of water at 25° C. was used as a cosurfactant and as a primary chain transfer agent. In a 2 liter jacketed glass reactor with a stirrer set at 300 rpm, 5.3 grams of DOWFAX 2A1™ (sodium tetrapropyl diphenyloxide disulfonate, 47 percent active, Dow Chemical), and 370 grams of deionized water were deaerated for 30 minutes while the temperature was raised to 80° C. A miniemulsion was prepared by homogenizing a monomer-polymer mixture (290 grams of styrene, 97 grams of n-butyl acrylate, 23.2 grams of 2-carboxyethyl acrylate, 15.5 grams of 1-dodecanethiol, and 33.5 grams of poly(vinyl butyral) (BUTVAR® B-79, crystallinity of 25 percent, $M_w$ of 65,000, available from Solutia)) with an aqueous solution of 1.3 grams of DOWFAX 2A1™, 3.9 grams of ammonium persulfate, and 224 grams of deionized water via VirTishear Cyclone Homogenizer at 10,000 rpm for 30 minutes at room temperature, about 25° C. throughout. The resulting miniemulsion was fed into the above reactor over a period of 105 minutes. At the conclusion of the monomer feed, the emulsion was post-heated at 80° C. for 30 minutes, then there was added an initiator aqueous solution of 1.9 grams of ammonium persulfate and 20 grams of deionized water. After the above initiator addition was completed, the reaction was allowed to post react for 90 minutes at 80° C., then cooled to 25° C. The resulting poly(vinyl butyral) containing polymer latex contained 42 percent solids comprised of amorphous poly(styrene-butyl acrylate-2-carboxyethyl acrylate) and semicrystalline poly(vinyl butyral), and possessed an average particle size of 343 nanometers as measured by light scattering technique on a Coulter N4 Plus Particle Sizer, and more specifically, the resulting product was comprised of about 92.4 percent of the amorphous polymer of poly (styrene-butyl acrylate-2-carboxyethyl acrylate), and the semicrystalline poly(vinyl butyral), about 7.6 percent by weight. The amorphous poly(styrene-butyl acrylate-2-carboxyethyl acrylate) polymer possessed an $M_w$ of 32,400, an $M_n$ of 10,500, both as determined on a Waters GPC, and a mid-point Tg of 52.1° C., as measured on a Seiko DSC.

LATEX EXAMPLE V

Poly(behenylpolyethoxyethyl methacrylate) Containing Polymer Latex:

A poly(behenylpolyethoxyethyl methacrylate) containing polymer latex comprised of a semicrystalline poly(behenylpolyethoxyethyl methacrylate) polymer and an amorphous styrene/n-butyl acrylate/2-carboxyethyl acrylate terpolymer was synthesized by a semicontinuous, miniemulsion polymerization process. 1-Dodecanethiol with a solubility in water of $3\times10^{-5}$ grams per liter of water at 25° C. was used as a cosurfactant and as a primary chain transfer agent. In a 2 liter jacketed glass reactor with a stirrer set at 300 rpm, 5.3 grams of DOWFAX 2A1™ (sodium tetrapropyl diphenyloxide disulfonate, 47 percent active, Dow Chemical), and 370 grams of deionized water were deaerated for 30 minutes while the temperature was raised to 80° C. A miniemulsion was prepared by homogenizing a monomer-polymer mixture (290 grams of styrene, 97 grams of n-butyl acrylate, 23.2 grams of 2-carboxyethyl acrylate, 15.5 grams of 1-dodecanethiol, and 37 grams of poly (behenylpolyethoxyethyl methacrylate) (crystallinity of 25 percent, $M_w$ of 46,000, available from Rhone-Poulenc)) with an aqueous solution of 1.3 grams of DOWFAX 2A1™, 3.9 grams of ammonium persulfate, and 224 grams of deionized water via VirTishear Cyclone Homogenizer at 10,000 rpm for 30 minutes at room temperature, about 25° C. throughout. The resulting miniemulsion was fed into the above reactor over a period of 105 minutes. At the conclusion of the monomer feed, the emulsion was post-heated at 80° C. for 30 minutes, then there was added an initiator aqueous solution of 1.9 grams of ammonium persulfate and 20 grams of deionized water. After the above initiator addition was completed, the reaction was allowed to post react for 90 minutes at 80° C., then cooled to 25° C. The resulting poly(behenylpolyethoxyethyl methacrylate) containing polymer latex contained 42 percent solids comprised of the amorphous poly(styrene-butyl acrylate-2-carboxyethyl acrylate) and the semicrystalline poly(behenylpolyethoxyethyl methacrylate), and possessed an average particle size of 247 nanometers as measured by light scattering technique on a Coulter N4 Plus Particle Sizer, and more specifically, the resulting product was comprised of about 91.7 percent of the amorphous polymer of poly(styrene-butyl acrylate-2-carboxyethyl acrylate), and the semicrystalline poly(behenylpolyethoxyethyl methacrylate), about 8.3 percent by weight. The amorphous poly(styrene-butyl acrylate-2-carboxyethyl acrylate) polymer possessed an $M_w$ of 36,500, an $M_n$ of 11,000, both as determined on a Waters GPC, and a mid-point Tg of 52.3° C., as measured on a Seiko DSC.

LATEX EXAMPLE IV

Poly(octadecyl methacrylate) Containing Polymer Latex:

A poly(octadecyl methacrylate) containing polymer latex comprised of a semicrystalline poly(octadecyl methacrylate) polymer and an amorphous styrene/n-butyl acrylate/2-carboxyethyl acrylate terpolymer was synthesized by a semicontinuous, miniemulsion polymerization process. 1-Dodecanethiol, with a solubility in water of $3\times10^{-5}$ grams per liter of water at 25° C., was used as a cosurfactant and as a primary chain transfer agent. In a 2 liter jacketed glass reactor with a stirrer set at 300 rpm, 5.3 grams of DOWFAX 2A1™ (sodium tetrapropyl diphenyloxide disulfonate, 47 percent active, Dow Chemical), and 370 grams of deionized water were deaerated for 30 minutes while the temperature was raised to 80° C. A miniemulsion was prepared by homogenizing a monomer-polymer mixture (290 grams of styrene, 97 grams of n-butyl acrylate, 23.2 grams of 2-carboxyethyl acrylate, 15.5 grams of 1-dodecanethiol, and 40 grams of poly(octadecyl methacrylate) (crystallinity of 26 percent, $M_w$ of 85,000, available from Scientific Polymer Products) with an aqueous solution of 1.3 grams of DOWFAX 2A1™, 3.9 grams of ammonium persulfate, and 224 grams of deionized water via VirTishear Cyclone Homogenizer at 10,000 rpm for 30 minutes at room temperature, about 25° C. throughout. The resulting miniemulsion was fed into the above reactor over a period of 105 minutes. At the conclusion of the monomer feed, the emulsion was post-heated at 80° C. for 30 minutes, then there was added an initiator aqueous solution of 1.9 grams of ammonium persulfate and 20 grams of deionized water. After the above initiator addition was completed, the reaction was allowed to post react for 90 minutes at 80° C., then cooled to 25° C. The resulting poly(octadecyl methacrylate) containing polymer latex contained 42 percent solids comprised of amorphous poly(styrene-butyl acrylate-2-carboxyethyl acrylate) and semicrystalline poly(octadecyl methacrylate), and possessed an average particle size of 209 nanometers as measured by light scattering technique on a Coulter N4 Plus Particle Sizer, and more specifically, the resulting product was comprised of about 91.1 percent of the amorphous polymer of poly(styrene-butyl acrylate-2-carboxyethyl acrylate), and the poly(octadecyl methacrylate), about 8.9 percent by weight. The amorphous poly(styrene-butyl acrylate-2-carboxyethyl acrylate) polymer possessed an $M_w$ of 34,100, an $M_n$ of 10,800, both as determined on a Waters GPC, and a mid-point Tg of 51.6° C., as measured on a Seiko DSC.

EXAMPLE 1

5.6 Micron Cyan Toner Particles Generated by a PAC A/C Process:

The polycaprolactone polymer dispersion of Dispersion Example I above was utilized in an aggregation/coalescence process to produce 5.6 micron (volume average diameter) particles with a narrow size distribution.

500 Grams of deionized water were placed in a stainless steel beaker and homogenized at 5,000 rpm, while 60 grams of the above prepared polycaprolactone polymer dispersion of Dispersion Example I and 268 grams of the above prepared amorphous poly(styrene-butyl acrylate-acrylic acid-β-carboxyethyl acrylate) polymer latex of Latex Example I were added, and 37.16 grams of crystalline polyethylene wax POLYWAX 725® dispersion (crystallinity of 85 percent, $M_w$ of 725, 31 percent active, available from Baker-Petrolite), and 5.7 grams of SNOWTEX® colloidal silica dispersion (21 percent active, available from Nissan Chemical) were added followed by the addition of 31.6 grams of the PB15:3 cyan pigment dispersion (17 percent active, available from Sun Chemicals) diluted with 110 grams of deionized water. To the resulting homogenized latex/pigment blend, 2.4 grams of 10 percent PAC (polyaluminum chloride) solution diluted with 24 grams of 0.02N $HNO_3$ were added dropwise causing flocculation of the cyan pigment, 5 percent by weight, the POLYWAX 725®, 9 percent by weight, the SNOWTEX® colloidal silica, 1 percent by weight, the polycaprolactone resin, 9 weight percent, the poly(styrene-butyl acrylate-2-carboxyethyl acrylate) resin, 75.8 weight percent, and 0.2 weight percent of the PAC. After the addition was complete, homogenization was continued for an additional 2 minutes to form a creamy blend with an average particle diameter size by volume of 2.69, and a GSDv of 1.21, as measured on a Coulter Counter Multisizer II particle sizer. The creamy blend was then transferred into a 2 liter glass reactor and stirred at 350 rpm, while being heated to about 52° C. to about 53° C. Particle growth was monitored during heating. When the particle size by volume was equal to 5.55 (GSDv=1.22), the pH of the slurry was adjusted to 7.5 by the addition of 2 percent NaOH and the speed in the reactor was reduced to 200 rpm, wherein the slurry was comprised of about 16 weight percent of toner and about 84 weight percent of water, wherein the toner was comprised of about 5 percent of cyan pigment PB15:3, about 1 percent of SNOWTEX® colloidal silica, about 9 percent of crystalline polyethylene wax POLYWAX 725®, about 9 percent by weight of semicrystalline polycaprolactone, about 75.8 percent by weight of amorphous poly(styrene-butyl acrylate-2-carboxyethyl acrylate), and about 0.2 percent of PAC, and wherein the total amount of the toner components was about 100 percent. After ½ hour of stirring at 53° C., the temperature in the reactor was raised to 95° C. After 1 hour of heating at 95° C., the pH of the slurry was adjusted to 4.3 and the heating was continued for an additional 5 hours. Subsequently, the reactor contents were cooled down and discharged. A 16 percent solids slurry of 5.58 micron cyan toner particles with GSDv=1.22 was obtained. The resulting toner product was comprised of about 5 percent of cyan pigment PB15:3, about 1 percent of SNOWTEX® colloidal silica, about 9 percent of crystalline polyethylene wax POLYWAX 725®, about 9 percent by weight of semicrystalline polycaprolactone, about 75.8 percent by weight of amorphous poly(styrene-butyl acrylate-2-carboxyethyl acrylate), and about 0.2 percent of PAC, and wherein the total amount of the toner components was about 100 percent. The resulting toner particles were washed with deionized water five times.

EXAMPLE 2

5.7 Micron Cyan Toner Particles Generated by a PAC A/C Process:

The poly(ethylene-vinyl acetate) polymer dispersion of Dispersion Example II above was utilized in an aggregation/coalescence process to produce 5.7 micron (volume average diameter) particles with a narrow size distribution.

500 Grams of deionized water were placed in a stainless steel beaker and homogenized at 5,000 rpm, while 66 grams of the above prepared polycaprolactone polymer dispersion of Dispersion Example II and 265 grams of the above prepared amorphous poly(styrene-butyl acrylate-acrylic acid-β-carboxyethyl acrylate) polymer latex of Latex Example I were added, and 37.16 grams of crystalline polyethylene wax POLYWAX 725® dispersion (crystallinity of 85 percent, 31 percent active) and 5.7 grams of SNOWTEX® colloidal silica dispersion (21 percent active) were added followed by the addition of 31.6 grams of the PB15:3 cyan pigment dispersion (17 percent active) diluted with 110 grams of deionized water. To the resulting homogenized latex/pigment blend, 2.4 grams of 10 percent PAC solution diluted with 24 grams of 0.02N $HNO_3$ were added dropwise causing flocculation of the cyan pigment, 5 percent by weight, the POLYWAX 725®, 9 percent by weight, the SNOWTEX® colloidal silica, 1 percent by weight, the poly(ethylene-vinyl acetate) resin, 10 weight percent, the poly(styrene-butyl acrylate-2-carboxyethyl acrylate) resin, 74.8 weight percent, and 0.2 weight percent of the PAC. After the addition was complete, homogenization was continued for an additional 2 minutes to form a creamy blend with an average particle diameter size by volume of 2.82, and a GSDv of 1.24, as measured on a Coulter Counter Multisizer II particle sizer. The creamy blend was then transferred into a 2 liter glass reactor and stirred at 350 rpm, while being heated to about 52° C. to about 53° C. Particle growth was monitored during heating. When the particle size by volume was equal to 5.70 (GSDv=1.23), the pH of the slurry was adjusted to 7.5 by the addition of 2 percent NaOH and the speed in the reactor was reduced to 200 rpm, wherein the slurry was comprised of about 16 weight percent of toner and of about 84 weight percent of water, wherein the toner was comprised of about 5 percent of cyan pigment PB15:3, about 1 percent of SNOWTEX® colloidal silica, about 9 percent of crystalline polyethylene wax POLYWAX 725®, about 10 percent by weight of semicrystalline poly(ethylene-vinyl acetate), about 74.8 percent by weight of amorphous poly(styrene-butyl acrylate-2-carboxyethyl acrylate), and about 0.2 percent of PAC, and wherein the total amount of the toner components was about 100 percent. After ½ hour of stirring at 53° C., the temperature in the reactor was raised to 95° C. After 1 hour of heating at 95° C., the pH of the slurry was adjusted to 4.3, and the heating was continued for an additional 5 hours. Subsequently, the reactor contents were cooled down and discharged. A 16 percent solids slurry of 5.72 micron cyan toner particles with GSDv=1.23 was obtained. The resulting toner product was comprised of about 5 percent of cyan pigment PB15:3, about 1 percent of SNOWTEX® colloidal silica, about 9 percent of crystalline polyethylene wax POLYWAX 725®, about 10 percent by weight of semicrystalline poly(ethylene-vinyl acetate), about 74.8 percent by weight of amorphous poly(styrene-butyl acrylate-2-carboxyethyl acrylate), and about 0.2 percent of PAC, and wherein the total amount of the toner components was about 100 percent. The resulting toner particles were washed with deionized water five times.

EXAMPLE 3

5.7 Micron Cyan Toner Particles Generated by a PAC A/C Process:

The poly(vinyl butyral) polymer dispersion of Dispersion Example III above was utilized in an aggregation/coalescence process to produce 5.7 micron (volume average diameter) particles with a narrow size distribution.

500 Grams of deionized water were placed in a stainless steel beaker and homogenized at 5,000 rpm, while 64 grams of the above prepared poly(vinyl butyral) polymer dispersion of Dispersion Example III, and 266 grams of the above prepared amorphous poly(styrene-butyl acrylate-acrylic acid-β-carboxyethyl acrylate) polymer latex of Latex Example I were added, and 37.16 grams of crystalline polyethylene wax POLYWAX 725® dispersion (crystallinity of 85 percent, 31 percent active) and 5.7 grams of SNOWTEX® colloidal silica dispersion (21 percent active) were added followed by the addition of 31.6 grams of the PB15:3 cyan pigment dispersion (17 percent active) diluted with 110 grams of deionized water. To the resulting homogenized latex/pigment blend, 2.4 grams of 10 percent PAC solution diluted with 24 grams of 0.02N $HNO_3$, were added dropwise causing flocculation of the cyan pigment, 5 percent by weight, the POLYWAX 725®, 9 percent by weight, the SNOWTEX® colloidal silica, 1 percent by weight, the poly(vinyl butyral) resin, 9.7 weight percent, the poly(styrene-butyl acrylate-2-carboxyethyl acrylate) resin, 75.1 weight percent, and 0.2 weight percent of the PAC. After the addition was complete, homogenization was continued for an additional 2 minutes to form a creamy blend with an average particle diameter size by volume of 2.75, and a GSDv of 1.21, as measured on a Coulter Counter Multisizer II particle sizer. The creamy blend was then transferred into a 2 liter glass reactor and stirred at 350 rpm, while being heated to about 52° C. to about 53° C. Particle growth was monitored during heating. When the particle size by volume was equal to 5.65 (GSDv=1.22), the pH of the slurry was adjusted to 7.5 by the addition of 2 percent NaOH and the speed in the reactor was reduced to 200 rpm, wherein the slurry was comprised of about 16 weight percent of toner and of about 84 weight percent of water, wherein the toner was comprised of about 5 percent of cyan pigment PB15:3, about 1 percent of SNOWTEX® colloidal silica, about 9 percent of crystalline polyethylene wax POLYWAX 725®, about 9.7 percent by weight of semicrystalline poly(vinyl butyral), about 75.1 percent by weight of amorphous poly (styrene-butyl acrylate-2-carboxyethyl acrylate), and about 0.2 percent of PAC, and wherein the total amount of the toner components was about 100 percent. After ½ hour of stirring at 53° C., the temperature in the reactor was raised to 95° C. After 1 hour of heating at 95° C., the pH of the slurry was adjusted to 4.3 and the heating was continued for an additional 5 hours. Subsequently, the reactor contents were cooled down and discharged. A 16 percent solids slurry of 5.70 micron cyan toner particles with GSDv=1.22 was obtained. The resulting toner product was comprised of about 5 percent of cyan pigment PB15:3, about 1 percent of SNOWTEX® colloidal silica, about 9 percent of crystalline polyethylene wax POLYWAX 725®, about 9.7 percent by weight of semicrystalline poly(vinyl butyral), about 75.1 percent by weight of amorphous poly(styrene-butyl acrylate-2-carboxyethyl acrylate), and about 0.2 percent of PAC, and wherein the total amount of the toner components was about 100 percent. The resulting toner particles were washed with deionized water five times.

EXAMPLE 4

5.8 Micron Cyan Toner Particles Generated by a PAC A/C Process:

The poly(ethylene oxide) polymer dispersion of Dispersion Example IV above was utilized in an aggregation/coalescence process to produce 5.8 micron (volume average diameter) particles with a narrow size distribution.

500 Grams of deionized water were placed in a stainless steel beaker and homogenized at 5,000 rpm, while 80 grams of the above prepared poly(ethylene oxide) polymer dispersion of Dispersion Example IV, and 258 grams of the above prepared amorphous poly(styrene-butyl acrylate-acrylic acid-β-carboxyethyl acrylate) polymer latex of Latex Example I were added, and 37.16 grams of crystalline polyethylene wax POLYWAX 725® dispersion (crystallinity of 85 percent, 31 percent active), and 5.7 grams of SNOWTEX® colloidal silica dispersion (21 percent active) were added followed by the addition of 31.6 grams of the PB15:3 cyan pigment dispersion (17 percent active) diluted with 110 grams of deionized water. To the resulting homogenized latex/pigment blend, 2.4 grams of 10 percent PAC solution diluted with 24 grams of 0.02N $HNO_3$ were added dropwise causing flocculation of the cyan pigment, 5 percent by weight, the POLYWAX 725®, 9 percent by weight, the SNOWTEX® colloidal silica, 1 percent by weight, the poly(ethylene oxide) resin, 12 weight percent, the poly (styrene-butyl acrylate-2-carboxyethyl acrylate) resin, 72.8 weight percent, and 0.2 weight percent of the PAC. After the addition was complete, homogenization was continued for an additional 2 minutes to form a creamy blend with an average particle diameter size by volume of 3.01, and a GSDv of 1.23, as measured on a Coulter Counter Multisizer II particle sizer. The creamy blend was then transferred into a 2 liter glass reactor and stirred at 350 rpm, while being heated to about 52° C. to about 53° C. Particle growth was monitored during heating. When the particle size by volume was equal to 5.75 (GSDv=1.23), the pH of the slurry was adjusted to 7.5 by the addition of 2 percent NaOH, and the speed in the reactor was reduced to 200 rpm, wherein the slurry was comprised of about 16 weight percent of toner and of about 84 weight percent of water, wherein the toner was comprised of about 5 percent of cyan pigment PB15:3, about 1 percent of SNOWTEX® colloidal silica, about 9 percent of crystalline polyethylene wax POLYWAX 725®, about 12 percent by weight of semicrystalline poly(ethylene oxide), about 72.8 percent by weight of amorphous poly (styrene-butyl acrylate-2-carboxyethyl acrylate), and about 0.2 percent of PAC, and wherein the total amount of the toner components was about 100 percent. After ½ hour of stirring at 53° C., the temperature in the reactor was raised to 95° C. After 1 hour of heating at 95° C., the pH of the slurry was adjusted to 4.3 and the heating was continued for an additional 5 hours. Subsequently, the reactor contents were cooled down and discharged. A 16 percent solids slurry of 5.79 micron cyan toner particles with GSDv=1.22 was obtained. The resulting toner product was comprised of about 5 percent of cyan pigment PB15:3, about 1 percent of SNOWTEX® colloidal silica, about 9 percent of crystalline polyethylene wax POLYWAX 725®, about 12 percent by weight of semicrystalline poly(ethylene oxide), about 72.8 percent by weight of amorphous poly(styrene-butyl acrylate-2-carboxyethyl acrylate), and about 0.2 percent of PAC, and wherein the total amount of the toner components was about 100 percent. The resulting toner particles were washed with deionized water five times.

EXAMPLE 5

5.6 Micron Cyan Toner Particles Generated by a PAC A/C Process:

The poly(behenylpolyethoxyethyl methacrylate) polymer dispersion of Dispersion Example V above was utilized in an aggregation/coalescence process to produce 5.6 micron (volume average diameter) particles with a narrow size distribution.

500 Grams of deionized water were placed in a stainless steel beaker and homogenized at 5,000 rpm, while 67 grams of the above prepared poly(behenylpolyethoxyethyl methacrylate) polymer dispersion of Dispersion Example V, and 265 grams of the above prepared amorphous poly(styrene-butyl acrylate-acrylic acid-β-carboxyethyl acrylate) polymer latex of Latex Example I were added, and 37.16 grams of crystalline polyethylene wax POLYWAX 725® dispersion (crystallinity of 85 percent, 31 percent active), and 5.7 grams of SNOWTEX® colloidal silica dispersion (21 percent active) were added followed by the addition of 31.6 grams of the PB15:3 cyan pigment dispersion (17 percent active) diluted with 110 grams of deionized water. To the resulting homogenized latex/pigment blend, 2.4 grams of 10 percent PAC solution diluted with 24 grams of 0.02N $HNO_3$ were added dropwise causing flocculation of the cyan pigment, 5 percent by weight, the POLYWAX 725®, 9 percent by weight, the SNOWTEX® colloidal silica, 1 percent by weight, the poly(behenylpolyethoxyethyl methacrylate) resin, 10 weight percent, the poly(styrene-butyl acrylate-2-carboxyethyl acrylate) resin, 74.8 weight percent, and 0.2 weight percent of the PAC. After the addition was complete, homogenization was continued for an additional 2 minutes to form a creamy blend with an average particle diameter size by volume of 2.72, and a GSDv of 1.23, as measured on a Coulter Counter Multisizer II particle sizer. The creamy blend was then transferred into a 2 liter glass reactor and stirred at 350 rpm, while being heated to about 52° C. to about 53° C. Particle growth was monitored during heating. When the particle size by volume was equal to 5.55 (GSDv=1.22), the pH of the slurry was adjusted to 7.5 by the addition of 2 percent NaOH and the speed in the reactor was reduced to 200 rpm, wherein the slurry was comprised of about 16 weight percent of toner and about 84 weight percent of water, wherein the toner was comprised of about 5 percent of cyan pigment PB15:3, about 1 percent of SNOWTEX® colloidal silica, about 9 percent of crystalline polyethylene wax POLYWAX 725®, about 10 percent by weight of semicrystalline poly(behenylpolyethoxyethyl methacrylate), about 74.8 percent by weight of amorphous poly(styrene-butyl acrylate-2-carboxyethyl acrylate), and about 0.2 percent of PAC, and wherein the total amount of the toner components was about 100 percent. After ½ hour of stirring at 53° C., the temperature in the reactor was raised to 95° C. After 1 hour of heating at 95° C., the pH of the slurry was adjusted to 4.3 and the heating was continued for an additional 5 hours. Subsequently, the reactor contents were cooled down and discharged. A 16 percent solids slurry of 5.59 micron cyan toner particles with GSDv=1.22 was obtained. The resulting toner product was comprised of about 5 percent of cyan pigment PB15:3, about 1 percent of SNOWTEX® colloidal silica, about 9 percent of crystalline polyethylene wax POLYWAX 725®, about 10 percent by weight of semicrystalline poly(behenylpolyethoxyethyl methacrylate), about 74.8 percent by weight of amorphous poly(styrene-butyl acrylate-2-carboxyethyl acrylate), and about 0.2 percent of PAC, and wherein the total amount of the toner components was about 100 percent. The resulting toner particles were washed with deionized water five times.

EXAMPLE 6

5.6 Micron Cyan Toner Particles Generated by a PAC A/C Process:

The poly(octadecyl acrylate) polymer dispersion of Dispersion Example VI above was utilized in an aggregation/coalescence process to produce 5.6 micron (volume average diameter) particles with a narrow size distribution.

500 Grams of deionized water were placed in a stainless steel beaker and homogenized at 5,000 rpm, while 100 grams of the above prepared poly(octadecyl acrylate) polymer dispersion of Dispersion Example VI, and 247 grams of the above prepared amorphous poly(styrene-butyl acrylate-acrylic acid-β-carboxyethyl acrylate) polymer latex of Latex Example I were added, and 37.16 grams of crystalline polyethylene wax POLYWAX 725® dispersion (crystallinity of 85 percent, 31 percent active) and 5.7 grams of SNOWTEX® colloidal silica dispersion (21 percent active) were added followed by the addition of 31.6 grams of the PB15:3 cyan pigment dispersion (17 percent active) diluted with 110 grams of deionized water. To the resulting homogenized latex/pigment blend, 2.4 grams of 10 percent PAC solution diluted with 24 grams of 0.02N $HNO_3$ were added dropwise causing flocculation of the cyan pigment, 5 percent by weight, the POLYWAX 725®, 9 percent by weight, the SNOWTEX® colloidal silica, 1 percent by weight, the poly(octadecyl acrylate) resin, 15 weight percent, the poly (styrene-butyl acrylate-2-carboxyethyl acrylate) resin, 69.8 weight percent, and 0.2 weight percent of the PAC. After the addition was complete, homogenization was continued for an additional 2 minutes to form a creamy blend with an average particle diameter size by volume of 2.78, and a GSDv of 1.23, as measured on a Coulter Counter Multisizer II particle sizer. The creamy blend was then transferred into a 2 liter glass reactor and stirred at 350 rpm, while being heated to about 52° C. to about 53° C. Particle growth was monitored during heating. When the particle size by volume was equal to 5.61 (GSDv=1.23), the pH of the slurry was adjusted to 7.5 by the addition of 2 percent NaOH and the speed in the reactor was reduced to 200 rpm, wherein the slurry was comprised of about 16 weight percent of toner and of about 84 weight percent of water, wherein the toner was comprised of about 5 percent of cyan pigment PB15:3, about 1 percent of SNOWTEX® colloidal silica, about 9 percent of crystalline polyethylene wax POLYWAX 725®, about 15 percent by weight of poly(octadecyl acrylate), about 69.8 percent by weight of amorphous poly(styrene-butyl acrylate-2-carboxyethyl acrylate), and about 0.2 percent of PAC, and wherein the total amount of the toner components was about 100 percent. After ½ hour of stirring at 53° C., the temperature in the reactor was raised to 95° C. After 1 hour of heating at 95° C., the pH of the slurry was adjusted to 4.3 and the heating was continued for an additional 5 hours. Subsequently, the reactor contents were cooled down and discharged. A 16 percent solids slurry of 5.63 micron cyan toner particles with GSDv=1.23 was obtained. The resulting toner product was comprised of about 5 percent of cyan pigment PB15:3, about 1 percent of SNOWTEX® colloidal silica, about 9 percent of crystalline polyethylene wax POLYWAX 725®, about 15 percent by weight of semicrystalline poly(octadecyl acrylate), about 69.8 percent by weight of amorphous poly(styrene-butyl acrylate-2-carboxyethyl acrylate), and about 0.2 percent of PAC, and wherein the total amount of the toner components was about 100 percent. The resulting toner particles were washed with deionized water five times.

EXAMPLE 7

5.7 Micron Cyan Toner Particles Generated by a PAC A/C Process:

The polycaprolactone containing polymer latex of Latex Example II above was utilized in an aggregation/coalescence process to produce 5.7 micron (volume average diameter) particles with a narrow size distribution.

500 Grams of deionized water were placed in a stainless steel beaker and homogenized at 5,000 rpm, while 300 grams of the above prepared polycaprolactone containing polymer latex were added, and 37.16 grams of crystalline polyethylene wax POLYWAX 725® dispersion ($M_w$ of 725, crystallinity of 85 percent, 31 percent active, available from Baker-Petrolite) and 5.7 grams of SNOWTEX® colloidal silica dispersion (21 percent active, available from Nissan Chemical) were added followed by the addition of 31.6 grams of the PB15:3 cyan pigment dispersion (17 percent active, available from Sun Chemicals) diluted with 110 grams of deionized water. To the resulting homogenized latex/pigment blend, 2.4 grams of 10 percent PAC solution diluted with 24 grams of 0.02N $HNO_3$ were added dropwise causing flocculation of the cyan pigment, 5 percent by weight, the POLYWAX 725®, 9 percent by weight, the SNOWTEX® colloidal silica, 1 percent by weight, the polycaprolactone containing latex resin, 84.8 weight percent, and 0.2 weight percent of the PAC. After the addition was complete, homogenization was continued for an additional 2 minutes to form a creamy blend with an average particle diameter size by volume of 2.71, and a GSDv of 1.23, as measured on a Coulter Counter Multisizer II particle sizer. The creamy blend was then transferred into a 2 liter glass reactor and stirred at 350 rpm, while being heated to about 52° C. to about 53° C. Particle growth was monitored during heating. When the particle size by volume was equal to 5.64 (GSDv=1.21), the pH of the slurry was adjusted to 7.5 by the addition of 2 percent NaOH, and the speed in the reactor was reduced to 200 rpm, wherein the slurry was comprised of about 16 weight percent of toner and of about 84 weight percent of water, wherein the toner was comprised of about 5 percent of cyan pigment PB15:3, about 1 percent of SNOWTEX® colloidal silica, about 9 percent of crystalline polyethylene wax POLYWAX 725®, about 84.8 percent by weight of polycaprolactone containing latex resin, and about 0.2 percent of PAC, and wherein the total amount of the toner components was about 100 percent. After ½ hour of stirring at 53° C., the temperature in the reactor was raised to 95° C. After 1 hour of heating at 95° C., the pH of the slurry was adjusted to 4.3 and the heating was continued for an additional 5 hours. Subsequently, the reactor contents were cooled down and discharged. A 16 percent solids slurry of 5.66 micron cyan toner particles with GSDv=1.22 was obtained. The resulting toner product was comprised of about 5 percent of cyan pigment PB15:3, about 1 percent of SNOWTEX® colloidal silica, about 9 percent of crystalline polyethylene wax POLYWAX 725®, about 6.4 percent by weight of semicrystalline polycaprolactone, about 78.4 percent by weight of amorphous poly(styrene-butyl acrylate-2-carboxyethyl acrylate), and about 0.2 percent of PAC, and wherein the total amount of the toner components was about 100 percent. The resulting toner particles were washed with deionized water five times.

EXAMPLE 8

5.6 Micron Cyan Toner Particles Generated by a PAC A/C Process:

The poly(ethylene-vinyl acetate) containing polymer latex of Latex Example III above was utilized in an aggregation/coalescence process to produce 5.6 micron (volume average diameter) particles with a narrow size distribution.

500 Grams of deionized water were placed in a stainless steel beaker and homogenized at 5,000 rpm, while 300 grams of the above prepared poly(ethylene-vinyl acetate) containing polymer latex were added, and 37.16 grams of crystalline polyethylene wax POLYWAX 725® dispersion (crystallinity of 85 percent, 31 percent active) and 5.7 grams of SNOWTEX® colloidal silica dispersion (21 percent active) were added followed by the addition of 31.6 grams of the PB15:3 cyan pigment dispersion (17 percent active) diluted with 110 grams of deionized water. To the resulting homogenized latex/pigment blend, 2.4 grams of 10 percent PAC solution diluted with 24 grams of 0.02N $HNO_3$ were added dropwise causing flocculation of the cyan pigment, 5 percent by weight, the POLYWAX 725®, 9 percent by weight, the SNOWTEX® colloidal silica, 1 percent by weight, the poly(ethylene-vinyl acetate) containing latex resin, 84.8 weight percent, and 0.2 weight percent of the PAC. After the addition was complete, homogenization was continued for an additional 2 minutes to form a creamy blend with an average particle diameter size by volume of 2.80, and a GSDv of 1.23, as measured on a Coulter Counter Multisizer II particle sizer. The creamy blend was then transferred into a 2 liter glass reactor and stirred at 350 rpm, while being heated to about 52° C. to about 53° C. Particle growth was monitored during heating. When the particle size by volume was equal to 5.58 (GSDv=1.22), the pH of the slurry was adjusted to 7.5 by the addition of 2 percent NaOH and the speed in the reactor was reduced to 200 rpm, wherein the slurry was comprised of about 16 weight percent of toner and of about 84 weight percent of water, wherein the toner was comprised of about 5 percent of cyan pigment PB15:3, about 1 percent of SNOWTEX® colloidal silica, about 9 percent of crystalline polyethylene wax POLYWAX 725®, about 84.8 percent by weight of poly (ethylene-vinyl acetate) containing latex resin, and about 0.2 percent of PAC, and wherein the total amount of the toner components was about 100 percent. After ½ hour of stirring at 53° C., the temperature in the reactor was raised to 95° C. After 1 hour of heating at 95° C., the pH of the slurry was adjusted to 4.3 and the heating was continued for an additional 5 hours. Subsequently, the reactor contents were cooled down and discharged. A 16 percent solids slurry of 5.60 micron cyan toner particles with GSDv=1.23 was obtained. The resulting toner product was comprised of about 5 percent of cyan pigment PB15:3, about 1 percent of SNOWTEX® colloidal silica, about 9 percent of crystalline polyethylene wax POLYWAX 725®, about 6.4 percent by weight of semicrystalline poly(ethylene-vinyl acetate), about 78.4 percent by weight of the amorphous poly(styrene-butyl acrylate-2-carboxyethyl acrylate), and about 0.2 percent of PAC and wherein the total amount of the toner components was about 100 percent. The resulting toner particles were washed with deionized water five times.

EXAMPLE 9

5.6 Micron Cyan Toner Particles Generated by a PAC A/C Process:

The poly(vinyl butyral) containing polymer latex of Latex Example IV above was utilized in an aggregation/coalescence process to produce 5.6 micron (volume average diameter) particles with a narrow size distribution.

500 Grams of deionized water were placed in a stainless steel beaker and homogenized at 5,000 rpm, while 300 grams of the above prepared poly(vinyl butyral) containing polymer latex were added, and 37.16 grams of crystalline polyethylene wax POLYWAX 725® dispersion (crystallinity of 85 percent, 31 percent active) and 5.7 grams of SNOWTEX® colloidal silica dispersion (21 percent active) were added followed by the addition of 31.6 grams of the PB15:3 cyan pigment dispersion (17 percent active) diluted with 110 grams of deionized water. To the resulting homogenized latex/pigment blend, 2.4 grams of 10 percent PAC solution diluted with 24 grams of 0.02N $HNO_3$ were added dropwise causing flocculation of the cyan pigment, 5 percent by weight, the POLYWAX 725®, 9 percent by weight, the SNOWTEX® colloidal silica, 1 percent by weight, the poly(vinyl butyral) containing latex resin, 84.8 weight percent, and 0.2 weight percent of the PAC. After the addition was complete, homogenization was continued for an additional 2 minutes to form a creamy blend with an average particle diameter size by volume of 2.91, and a GSDv of 1.22, as measured on a Coulter Counter Multisizer II particle sizer. The creamy blend was then transferred into a 2 liter glass reactor and stirred at 350 rpm, while being heated to about 52° C. to about 53° C. Particle growth was monitored during heating. When the particle size by volume was equal to 5.61 (GSDv=1.21), the pH of the slurry was adjusted to 7.5 by the addition of 2 percent NaOH and the speed in the reactor was reduced to 200 rpm, wherein the slurry was comprised of about 16 weight percent of toner and about 84 weight percent of water, wherein the toner was comprised of about 5 percent of cyan pigment PB15:3, about 1 percent of SNOWTEX® colloidal silica, about 9 percent of crystalline polyethylene wax POLYWAX 725®, about 84.8 percent by weight of poly(vinyl butyral) containing latex resin, and about 0.2 percent of PAC, and wherein the total amount of the toner components was about 100 percent. After ½ hour of stirring at 53° C., the temperature in the reactor was raised to 95° C. After 1 hour of heating at 95° C., the pH of the slurry was adjusted to 4.3, and the heating was continued for an additional 5 hours. Subsequently, the reactor contents were cooled down and discharged. A 16 percent solids slurry of 5.63 micron cyan toner particles with a GSDv of 1.22 was obtained. The resulting toner product was comprised of about 5 percent of cyan pigment PB15:3, about 1 percent of SNOWTEX® colloidal silica, about 9 percent of the crystalline polyethylene wax POLYWAX 725®, about 6.4 percent by weight of semicrystalline poly(vinyl butyral), about 78.4 percent by weight of amorphous poly(styrene-butyl acrylate-2-carboxyethyl acrylate), and about 0.2 percent of PAC, and wherein the total amount of the toner components was about 100 percent. The resulting toner particles were washed with deionized water five times.

EXAMPLE 10

5.6 Micron Cyan Toner Particles Generated by a PAC A/C Process:

The poly(behenylpolyethoxyethyl methacrylate) containing polymer latex of Latex Example V above was utilized in an aggregation/coalescence process to produce 5.6 micron (volume average diameter) particles with a narrow size distribution.

500 Grams of deionized water were placed in a stainless steel beaker and homogenized at 5,000 rpm, while 300 grams of the above prepared poly(behenylpolyethoxyethyl methacrylate) containing polymer latex were added, and 37.16 grams of crystalline polyethylene wax POLYWAX 725® dispersion (crystallinity of 85 percent, 31 percent active) and 5.7 grams of SNOWTEX® colloidal silica dispersion (21 percent active) were added followed by the addition of 31.6 grams of the PB15:3 cyan pigment dispersion (17 percent active) diluted with 110 grams of deionized water. To the resulting homogenized latex/pigment blend, 2.4 grams of 10 percent PAC solution diluted with 24 grams of 0.02N $HNO_3$ were added dropwise causing flocculation of the cyan pigment, 5 percent by weight, the POLYWAX 725®, 9 percent by weight, the SNOWTEX® colloidal silica, 1 percent by weight, the poly(behenylpolyethoxyethyl methacrylate) containing latex resin, 84.8 weight percent, and 0.2 weight percent of the PAC. After the addition was complete, homogenization was continued for an additional 2 minutes to form a creamy blend with an average particle diameter size by volume of 2.75, and a GSDv of 1.22, as measured on a Coulter Counter Multisizer II particle sizer. The creamy blend was then transferred into a 2 liter glass reactor and stirred at 350 rpm, while being heated to about 52° C. to about 53° C. Particle growth was monitored during heating. When the particle size by volume was equal to 5.62 (GSDv=1.22), the pH of the slurry was adjusted to 7.5 by the addition of 2 percent NaOH, and the speed in the reactor was reduced to 200 rpm, wherein the slurry was comprised of about 16 weight percent of toner and about 84 weight percent of water, wherein the toner was comprised of about 5 percent of cyan pigment PB15:3, about 1 percent of SNOWTEX® colloidal silica, about 9 percent of crystalline polyethylene wax POLYWAX 725®, about 84.8 percent by weight of poly(behenylpolyethoxyethyl methacrylate) containing latex resin, and about 0.2 percent of PAC, and wherein the total amount of the toner components was about 100 percent. After ½ hour of stirring at 53° C., the temperature in the reactor was raised to 95° C. After 1 hour of heating at 95° C., the pH of the slurry was adjusted to 4.3 and the heating was continued for an additional 5 hours.

Subsequently, the reactor contents were cooled down and discharged. A 16 percent solids slurry of 5.64 micron cyan toner particles with GSDv=1.20 was obtained. The resulting toner product was comprised of about 5 percent of cyan pigment PB15:3, about 1 percent of SNOWTEX® colloidal silica, about 9 percent of crystalline polyethylene wax POLYWAX 725®, about 7 percent by weight of the semicrystalline poly(behenylpolyethoxyethyl methacrylate), about 77.8 percent by weight of amorphous poly(styrene-butyl acrylate-2-carboxyethyl acrylate), and about 0.2 percent of PAC, and wherein the total amount of the toner components was about 100 percent. The resulting toner particles were washed with deionized water five times.

EXAMPLE 11

5.6 Micron Cyan Toner Particles Generated by a PAC A/C Process:

The poly(octadecyl methacrylate) containing polymer latex of Latex Example VI above was utilized in an aggregation/coalescence process to produce 5.6 micron (volume average diameter) particles with a narrow size distribution.

500 Grams of deionized water were placed in a stainless steel beaker and homogenized at 5,000 rpm, while 300 grams of the above prepared poly(octadecyl methacrylate) containing polymer latex were added, and 37.16 grams of crystalline polyethylene wax POLYWAX 725® dispersion (crystallinity of 85 percent, 31 percent active) and 5.7 grams of SNOWTEX® colloidal silica dispersion (21 percent active) were added followed by the addition of 31.6 grams of the PB15:3 cyan pigment dispersion (17 percent active) diluted with 110 grams of deionized water. To the resulting homogenized latex/pigment blend, 2.4 grams of 10 percent PAC solution diluted with 24 grams of 0.02N $HNO_3$ were added dropwise causing flocculation of the cyan pigment, 5 percent by weight, the POLYWAX 725®, 9 percent by weight, the SNOWTEX® colloidal silica, 1 percent by weight, the poly(octadecyl methacrylate) containing latex resin, 84.8 weight percent, and 0.2 weight percent of the PAC. After the addition was complete, homogenization was continued for an additional 2 minutes to form a creamy blend with an average particle diameter size by volume of 2.72, and a GSDv of 1.21, as measured on a Coulter Counter Multisizer II particle sizer. The creamy blend was then transferred into a 2 liter glass reactor and stirred at 350 rpm, while being heated to about 52° C. to about 53° C. Particle growth was monitored during heating. When the particle size by volume was equal to 5.61 (GSDv=1.20), the pH of the slurry was adjusted to 7.5 by the addition of 2 percent NaOH and the speed in the reactor was reduced to 200 rpm, wherein the slurry was comprised of about 16 weight percent of toner and about 84 weight percent of water, wherein the toner was comprised of about 5 percent of cyan pigment PB15:3, about 1 percent of SNOWTEX® colloidal silica, about 9 percent of crystalline polyethylene wax POLYWAX 725®, about 84.8 percent by weight of poly (octadecyl methacrylate) containing latex resin, and about 0.2 percent of PAC and wherein the total amount of the toner components was about 100 percent. After ½ hour of stirring at 53° C., the temperature in the reactor was raised to 95° C. After 1 hour of heating at 95° C., the pH of the slurry was adjusted to 4.3 and the heating was continued for an additional 5 hours. Subsequently, the reactor contents were cooled down and discharged. A 16 percent solids slurry of 5.62 micron cyan toner particles with GSDv=1.19 was obtained. The resulting toner product was comprised of about 5 percent of cyan pigment PB15:3, about 1 percent of SNOWTEX® colloidal silica, about 9 percent of crystalline polyethylene wax POLYWAX 725®, about 7.5 percent by weight of semicrystalline poly(octadecyl methacrylate), about 77.3 percent by weight of amorphous poly(styrene-butyl acrylate-2-carboxyethyl acrylate), and about 0.2 percent of PAC, and wherein the total amount of the toner components was about 100 percent. The resulting toner particles were washed with deionized water five times.

COMPARATIVE EXAMPLE 1

5.6 Micron Cyan Toner Particles Generated by a PAC A/C Process:

The poly(styrene-butyl acrylate-2-carboxyethyl acrylate) polymer latex of Latex Example I above was utilized in an aggregation/coalescence process to produce 5.6 micron (volume average diameter) particles with a narrow size distribution.

500 Grams of deionized water were placed in a stainless steel beaker and homogenized at 5,000 rpm, while 300 grams of the above prepared amorphous poly(styrene-butyl acrylate-2-carboxyethyl acrylate) polymer latex were added, and 37.16 grams of crystalline polyethylene wax POLYWAX 725® dispersion (crystallinity of 85 percent, 31 percent active) and 5.7 grams of SNOWTEX® colloidal silica dispersion (21 percent active) were added followed by the addition of 31.6 grams of the PB15:3 cyan pigment dispersion (17 percent active) diluted with 110 grams of deionized water. To the resulting homogenized latex/pigment blend, 2.4 grams of 10 percent PAC solution diluted with 24 grams of 0.02N $HNO_3$ were added dropwise causing flocculation of the cyan pigment, 5 percent by weight, the POLYWAX 725®, 9 percent by weight, the SNOWTEX® colloidal silica, 1 percent by weight, the poly(styrene-butyl acrylate-2-carboxyethyl acrylate) latex resin, 84.8 weight percent, and 0.2 weight percent of the PAC. After the addition was complete, homogenization was continued for an additional 2 minutes to form a creamy blend with an average particle diameter size by volume of 2.73, and a GSDv of 1.22, as measured on a Coulter Counter Multisizer II particle sizer. The creamy blend was then transferred into a 2 liter glass reactor and stirred at 350 rpm, while being heated to about 52° C. to about 53° C. Particle growth was monitored during heating. When the particle size by volume was equal to 5.61 (GSDv=1.21), the pH of the slurry was adjusted to 7.5 by the addition of 2 percent NaOH and the speed in the reactor was reduced to 200 rpm, wherein the slurry was comprised of about 16 weight percent of toner and about 84 weight percent of water, wherein the toner was comprised of about 5 percent of cyan pigment PB15:3, about 1 percent of SNOWTEX® colloidal silica, about 9 percent of crystalline polyethylene wax POLYWAX 725®, about 84.8 percent by weight of poly(styrene-butyl acrylate-2-carboxyethyl acrylate) latex resin, and about 0.2 percent of PAC, and wherein the total amount of the toner components was about 100 percent. After ½ hour of stirring at 53° C., the temperature in the reactor was raised to 95° C. After 1 hour of heating at 95° C., the pH of the slurry was adjusted to 4.3 and the heating was continued for an additional 5 hours. Subsequently, the reactor contents were cooled down and discharged. A 16 percent solids slurry of 5.63 micron cyan toner particles with GSDv=1.20 was obtained. The resulting toner product was comprised of about 5 percent of cyan pigment PB15:3, about 1 percent of SNOWTEX® colloidal silica, about 9 percent of the crystalline polyethylene wax POLY- WAX 725®, about 84.8 percent by weight of amorphous poly(styrene-butyl acrylate-2-carboxyethyl acrylate), and about 0.2 percent of PAC, and wherein the total amount of the toner components was about 100 percent. The resulting toner particles were washed with deionized water five times.

COMPARATIVE EXAMPLE 2

5.6 Micron Cyan Toner Particles Generated by a PAC A/C Process:

The polycaprolactone polymer dispersion of Dispersion Example I above was utilized in an aggregation/coalescence process to produce 5.6 micron (volume average diameter) particles with a narrow size distribution.

500 Grams of deionized water were placed in a stainless steel beaker and homogenized at 5,000 rpm, while 60 grams of the above prepared polycaprolactone polymer dispersion of Dispersion Example I, and 300 grams of the above prepared amorphous poly(styrene-butyl acrylate-acrylic acid-β-carboxyethyl acrylate) polymer latex of Latex Example I were added, and 5.7 grams of SNOWTEX® colloidal silica dispersion (21 percent active) were added followed by the addition of 31.6 grams of the PB15:3 cyan pigment dispersion (17 percent active) diluted with 110 grams of deionized water. To the resulting homogenized latex/pigment blend, 2.4 grams of 10 percent PAC solution diluted with 24 grams of 0.02N $HNO_3$ were added dropwise causing flocculation of the cyan pigment, 5 percent by weight, the SNOWTEX® colloidal silica, 1 percent by weight, the polycaprolactone resin, 9 weight percent, the poly(styrene-butyl acrylate-2-carboxyethyl acrylate) resin, 84.8 weight percent, and 0.2 weight percent of the PAC. After the addition was complete, homogenization was continued for an additional 2 minutes to form a creamy blend with an average particle diameter size by volume of 2.56, and a GSDv of 1.21, as measured on a Coulter Counter Multisizer II particle sizer. The creamy blend was then transferred into a 2 liter glass reactor and stirred at 350 rpm, while being heated to about 52° C. to about 53° C. Particle growth was monitored during heating. When the particle size by volume was equal to 5.58 (GSDv=1.22), the pH of the slurry was adjusted to 7.5 by the addition of 2 percent NaOH and the speed in the reactor was reduced to 200 rpm, wherein the slurry was comprised of about 16 weight percent of toner and about 84 weight percent of water, wherein the toner was comprised of about 5 percent of cyan pigment PB15:3, about 1 percent of SNOWTEX® colloidal silica, about 9 percent by weight of semicrystalline polycaprolactone, about 84.8 percent by weight of amorphous poly(styrene-butyl acrylate-2-carboxyethyl acrylate), and about 0.2 percent of PAC, and wherein the total amount of the toner components was about 100 percent. After ½ hour of stirring at 53° C., the temperature in the reactor was raised to 95° C. After 1 hour of heating at 95° C., the pH of the slurry was adjusted to 4.3 and the heating was continued for an additional 5 hours. Subsequently, the reactor contents were cooled down and discharged. A 16 percent solids slurry of 5.58 micron cyan toner particles with GSDv=1.22 was obtained. The resulting toner product was comprised of about 5 percent of cyan pigment PB15:3, about 1 percent of SNOWTEX® colloidal silica, about 9 percent by weight of semicrystalline polycaprolactone, about 84.8 percent by weight of amorphous poly(styrene-butyl acrylate-2-carboxyethyl acrylate), and about 0.2 percent of PAC, and wherein the total amount of the toner components was about 100 percent. The resulting toner particles were washed with deionized water five times.

COMPARATIVE EXAMPLE 3

5.7 Micron Cyan Toner Particles Generated by a PAC A/C Process:

The polycaprolactone containing polymer latex of Latex Example II above was utilized in an aggregation/coalescence process to produce 5.7 micron (volume average diameter) particles with a narrow size distribution.

500 Grams of deionized water were placed in a stainless steel beaker and homogenized at 5,000 rpm, while 300 grams of the above prepared polycaprolactone containing polymer latex were added, and 5.7 grams of SNOWTEX® colloidal silica dispersion (21 percent active) were added followed by the addition of 31.6 grams of the PB15:3 cyan pigment dispersion (17 percent active) diluted with 110 grams of deionized water. To the resulting homogenized latex/pigment blend, 2.4 grams of 10 percent PAC solution diluted with 24 grams of 0.02N $HNO_3$ were added dropwise causing flocculation of the cyan pigment, 5 percent by weight, the SNOWTEX® colloidal silica, 1 percent by weight, the polycaprolactone containing latex resin, 93.8 weight percent, and 0.2 weight percent of the PAC. After the addition was complete, homogenization was continued for an additional 2 minutes to form a creamy blend with an average particle diameter size by volume of 2.73, and a GSDv of 1.23, as measured on a Coulter Counter Multisizer II particle sizer. The creamy blend was then transferred into a 2 liter glass reactor and stirred at 350 rpm, while being heated to about 52° C. to about 53° C. Particle growth was monitored during heating. When the particle size by volume was equal to 5.65 (GSDv=1.21), the pH of the slurry was adjusted to 7.5 by the addition of 2 percent NaOH and the speed in the reactor was reduced to 200 rpm, wherein the slurry was comprised of about 16 weight percent of toner and about 84 weight percent of water, wherein the toner was comprised of about 5 percent of cyan pigment PB15:3, about 1 percent of SNOWTEX® colloidal silica, about 93.8 percent by weight of polycaprolactone containing latex resin, and about 0.2 percent of PAC, and wherein the total amount of the toner components was about 100 percent. After ½ hour of stirring at 53° C., the temperature in the reactor was raised to 95° C. After 1 hour of heating at 95° C., the pH of the slurry was adjusted to 4.3 and the heating was continued for an additional 5 hours. Subsequently, the reactor contents were cooled down and discharged. A 16 percent solids slurry of 5.68 micron cyan toner particles with GSDv=1.22 was obtained. The resulting toner product was comprised of about 5 percent of cyan pigment PB15:3, about 1 percent of SNOWTEX® colloidal silica, about 7.1 percent by weight of semicrystalline polycaprolactone, about 86.7 percent by weight of amorphous poly(styrene-butyl acrylate-2-carboxyethyl acrylate), and about 0.2 percent of PAC, and wherein the total amount of the toner components was about 100 percent. The resulting toner particles were washed with deionized water five times.

COMPARATIVE EXAMPLE 4

5.6 Micron Cyan Toner Particles Generated by a PAC A/C Process:

The poly(styrene-butyl acrylate-2-carboxyethyl acrylate) polymer latex of Latex Example I above was utilized in an aggregation/coalescence process to produce 5.6 micron (volume average diameter) particles with a narrow size distribution.

500 Grams of deionized water were placed in a stainless steel beaker and homogenized at 5,000 rpm, while 332 grams of the above prepared amorphous poly(styrene-butyl acrylate-2-carboxyethyl acrylate) polymer latex were added, and 5.7 grams of SNOWTEX® colloidal silica dispersion (21 percent active) were added followed by the addition of 31.6 grams of the PB15:3 cyan pigment dispersion (17 percent active) diluted with 110 grams of deionized water. To the resulting homogenized latex/pigment blend, 2.4 grams of 10 percent PAC solution diluted with 24 grams of 0.02N $HNO_3$ were added dropwise causing flocculation of the cyan pigment, 5 percent by weight, the SNOWTEX® colloidal silica, 1 percent by weight, the poly(styrene-butyl acrylate-2-carboxyethyl acrylate) latex resin, 93.8 weight percent, and 0.2 weight percent of the PAC. After the addition was complete, homogenization was continued for an additional 2 minutes to form a creamy blend with an average particle diameter size by volume of 2.70, and a GSDv of 1.21, as measured on a Coulter Counter Multisizer II particle sizer. The creamy blend was then transferred into a 2 liter glass reactor and stirred at 350 rpm, while being heated to about 52° C. to about 53° C. Particle growth was monitored during heating. When the particle size by volume was equal to 5.63 (GSDv=1.20), the pH of the slurry was adjusted to 7.5 by the addition of 2 percent NaOH and the speed in the reactor was reduced to 200 rpm, wherein the slurry was comprised of about 16 weight percent of toner and about 84 weight percent of water, wherein the toner was comprised of about 5 percent of cyan pigment PB15:3, about 1 percent of SNOWTEX® colloidal silica, about 93.8 percent by weight of poly(styrene-butyl acrylate-2-carboxyethyl acrylate) latex resin, and about 0.2 percent of PAC, and wherein the total amount of the toner components was about 100 percent. After ½ hour of stirring at 53° C., the temperature in the reactor was raised to 95° C. After 1 hour of heating at 95° C., the pH of the slurry was adjusted to 4.3 and the heating was continued for an additional 5 hours. Subsequently, the reactor contents were cooled down and discharged. A 16 percent solids slurry of 5.64 micron cyan toner particles with GSDv=1.20 was obtained. The resulting toner product was comprised of about 5 percent of cyan pigment PB15:3, about 1 percent of SNOWTEX® colloidal silica, about 93.8 percent by weight of the amorphous poly(styrene-butyl acrylate-2-carboxyethyl acrylate), and about 0.2 percent of PAC, and wherein the total amount of the toner components was about 100 percent. The resulting toner particles were washed with deionized water five times.

Toner Fusing and Striping Evaluations:

Standard fusing properties of the above prepared toner compositions were evaluated throughout as follows. Unfused images of toner on paper with a controlled toner mass per unit area of 0.43 milligram/$cm^2$ were produced by one of a number of known methods, such as by utilizing the Xerox Corporation DocuColor™ 1632. A suitable electrophotographic developer was generated by mixing from about 2 to about 10 percent by weight of the toner with a suitable electrophotographic carrier, such as, for example, a 65 micron Hoeganaes steel core, spray coated with 0.5 weight percent of a terpolymer of poly(methyl methacrylate), styrene, and vinyltriethoxysilane, and roll milling the mixture for about 10 to about 30 minutes to achieve a triboelectrical charge of between about −5 to about −20 microcoulombs per gram of toner as measured by the known Faraday Cage process. The developer was introduced into a small electrophotographic copier, such as the Xerox Corporation 2240®, in which the fuser system had been disconnected. Between about 20 to about 50 unfused images of a test pattern of a 65 millimeter by 65 millimeter square solid area were produced on 8.5 by 11 inch sheets of a typical electrophotographic paper such as Xerox Corporation Image LX paper.

The unfused images were then fused by feeding them through a hot roll fuser consisting of a fuser roll and pressure roll with elastomer surfaces, both of which were heated to a controlled temperature. Fused images were produced over a range of hot roll fusing temperatures from about 130° C. to about 210° C. The gloss of the fused images was measured according to TAPPI Standard T480 at a 75° angle of incidence and reflection using a Novo-Gloss Statistical Gloss Meter, Model GL-NG 1002S from Paul N. Gardner Company, Inc. The degree of permanence of the fused images was evaluated by the Crease Test (crease test data can be expressed as MFT). The fused images were folded under a specific weight with the toner image to the inside of the fold. The image was then unfolded and any loose toner wiped from the resulting crease with a cotton swab. The average width of the paper substrate, which shows through the fused toner image in the vicinity of the crease, was measured with a custom built image analysis system.

The degree of permanence of the fused images was also characterized by the hot offset temperature (data can be expressed as HOT). When the heating is excessive, the viscosity of the toner was low. The toner complex viscosity (the complex viscosity is the sum of the storage elastic modulus and the loss elastic modulus divided by the measuring frequency), which was measured by a sinusoidal wave oscillation method at a frequency of 6 rad/second, was lower than about $5\times10^2$ Pas, and at the test temperature of from about 100° C. to about 250° C. At about 11 weight percent of the fused toner the fixing layer can adhere on the side of the fuser roll to cause undesirable hot offset. Typically, a resin having a higher molecular weight (of about higher than 35,000) can be used to prevent the hot offset due to excessive melting.

The fusing performance of a toner was judged from the fusing temperatures required to achieve excellent image gloss and fix. For high quality black applications, an image gloss greater than about 25 gloss units was preferred. For high quality color applications, an image gloss greater than about 35 gloss units was preferred. Similarly, the minimum fuser temperature required to produce a crease value less than the maximum acceptable crease was known as the Minimum Fix Temperature (MFT) for a given toner. In general, it was desirable to have an MFT as low as possible, such as for example MFT of below about 110° C., and more specifically, below 100° C. in order to primarily minimize the power requirements of the hot roll fuser. It may also be desirable to arrive at a hot offset temperature (HOT) higher than, for example, about 200° C., and preferably higher than about 210° C., such as 220° C., to ensure that toner does not adhere to a fixing fixture and to minimize/prevent hot offset.

The stripping (peelability) performance of a toner after fusing can be evaluated by the stripping force required to achieve acceptable stripping of fused toner substrate from the fuser roll. In oilless fixing (typically in xerographic fusing, silicon or mercaptan oils are used to assist toner substrate release from fuser roll. The term "oilless" refers, for example, to the use of no oil to assist substrate release; the stripping of the toner from the fixing roll generally depends on the stringiness of the molten toner. Stringiness is one of the properties characteristic of a toner resin molecular structure, such as the properties of resin molecular weight and polymer chain entanglement. As stringiness increases, stripping during oilless fixing worsens or decreases, that is, for example, the stripping force required will increase, and thus the stripping force required for stripping was increased. Stripping force was measured by using a remodeled version of a Color 645 Stripping Force Fixture (produced by Fuji Xerox) of fused toner on Fuji Xerox S paper with a controlled toner mass per unit area of 1.35 milligram/cm$^2$ with the fixing rate being predetermined to 200 mm/second, the carried amount of toner being predetermined to 4.5 grams/m$^2$, 9 grams/m$^2$ and 13.5 grams/m$^2$, and the fixing temperature being predetermined to 160° C., 180° C., and 200° C. The toner was peeled without any resistance regardless of the carried amount of the toner. In general, it was desirable to have a low stripping force, such as for example, a stripping force equal to or below 25 g/f (gram/force, and more specifically, gram-cm/sec$^2$), and more specifically, below 20 g/f in order to achieve a fixed image with a high surface gloss and with no or minimal high temperature offset.

TABLE 1

Fusing and Stripping Evaluation of Toner Particles

| | Example | | | | | | Comparative | Comparative | Comparative |
|---|---|---|---|---|---|---|---|---|---|
| | 1 | 2 | 3 | 4 | 5 | 6 | 1 | 2 | 4 |
| Amorphous polymer (wt percent of toner) | 75.8 | 74.8 | 75.1 | 72.8 | 74.8 | 69.8 | 84.8 | 84.8 | 93.8 |
| Semicrystalline polymer (wt percent of toner) | 9 | 10 | 9.7 | 12 | 10 | 15 | 0 | 9 | 0 |
| Crystalline polymer (wt percent of toner) | 9 | 9 | 9 | 9 | 9 | 9 | 9 | 0 | 0 |
| MFT (° C.) | 100 | 101 | 105 | 104 | 100 | 110 | 140 | 104 | 142 |
| HOT (° C.) | 220 | 220 | 220 | 220 | 220 | 220 | 220 | 190 | 180 |
| Stripping Force (g/f) | 7.1 | 7.3 | 6.8 | 7.4 | 6.5 | 8.5 | 8.8 | 27.5 | 34.5 |
| Gloss (ggu) | 35 | 37 | 35 | 35 | 42 | 35 | 35 | 38 | 37 |

The fusing and stripping evaluation of the toners of Examples 1 to 6, and Comparative Examples 1, 2 and 4 is summarized in Table 1. As indicated in Table 1, a toner containing a semicrystalline polymer and a highly crystalline polymer enable a toner with a low melt fusing characteristic, with a Minimum Fix Temperature (MFT) of below about 110° C., and more specifically, below 105° C., wherein the temperature dependence of stripping during oilless fixing can be suppressed, rendering it feasible to provide a toner developed image with excellent surface gloss for the fixed images, OHP transparency (transparency for overhead projector, such as the Xerox Corporation 3R6218) and bending resistance of the fixed image. Also, the toner stripping and fixing property at a high temperature, that is HOT, and the desired surface gloss can be ensured. In Comparative Example 1, wherein there was no semicrystalline polymer incorporated into the toner particles, the toner fixing properties at a low temperature of from about 80° C. to about 160° C. was deteriorated. In Comparative Example 1, the toner's MFT of 140° C. was higher than 110° C. In Comparative Example 2, wherein there was no crystalline polymer incorporated into the toner particles, generation of hot offset at a high temperature of 190° C. and an increase in stripping force associated thereto can result. This was shown in Comparative Example 2, where the toner's MFT of 104° C. was lower than 110° C., the toner's stripping force of 27.5 g/f was higher than 25 g/f, and HOT was below 200° C. (This toner, when fused, needed a higher stripping force than 25 g/f to be peeled off from a fuser roll. Also, this toner had a hot offset temperature (HOT) of 190° C., thus the fused toner tended to adhere to the fixing fixture at a lower temperature of about 195° C. It was desirable to have a toner HOT higher than about 200° C., and preferably higher than 210° C., of from about 210° C. to about 250° C. to, for example, prevent hot offset). In Comparative Example 3, wherein there was neither a semicrystalline polymer nor a crystalline polymer incorporated into the toner particles, the toner fixing properties at a low temperature was deteriorated. Generation of hot offset at a high temperature and increase in stripping force associated thereto can occur. This was shown in Comparative Example 3, where the toner's MFT of 142° C. was higher than 110° C., the toner's stripping force of 34.5 g/f was higher than 25 g/f, and HOT of 180° C. was below 200° C. (This toner, when fused, needed higher stripping force to be peeled off from a fuser roll. Also, this toner had a hot offset temperature (HOT) of 180° C., thus the fused toner tended to adhere to the fixing fixture at lower temperature of about 195° C. It was desirable to have a toner HOT higher than about 200° C., and preferably higher than 210° C., of from about 210° C. to about 250° C. to, for example, prevent hot offset).

TABLE 2

Fusing and Stripping Evaluation of Toner Particles

| | Example | | | | | Comparative | Comparative | Comparative |
|---|---|---|---|---|---|---|---|---|
| | 7 | 8 | 9 | 10 | 11 | 1 | 3 | 4 |
| Amorphous polymer (wt percent of toner) | 78.4 | 78.4 | 78.4 | 77.8 | 77.3 | 84.8 | 86.7 | 93.8 |
| Semicrystalline polymer (wt percent of toner) | 6.4 | 6.4 | 6.4 | 7 | 7.5 | 0 | 7.1 | 0 |
| Crystalline polymer (wt percent of toner) | 9 | 9 | 9 | 9 | 9 | 9 | 0 | 0 |
| MFT (° C.) | 90 | 93 | 95 | 89 | 90 | 140 | 88 | 142 |
| HOT (° C.) | 220 | 220 | 220 | 220 | 220 | 220 | 193 | 180 |
| Stripping Force (g/f) | 7.1 | 7.3 | 6.8 | 7.4 | 6.5 | 8.8 | 29.5 | 34.5 |
| Gloss (ggu) | 40 | 42 | 40 | 40 | 47 | 35 | 40 | 37 |

The fusing and stripping evaluation of the toners in Examples 7 to 11, and Comparative Examples 1, 3 and 4 is summarized in Table 2. A toner containing a semicrystalline polymer and a highly crystalline polymer enable a toner with low melt fusing property, wherein the Minimum Fix Temperature (MFT) is below about 110° C., and preferably below about 100° C.; the temperature dependence of stripping during oilless fixing can be suppressed, thereby permitting a toner developed image with excellent surface gloss for the fixed images; acceptable OHP transparency (transparency for overhead projector, such as the Xerox Corporation 3R6218), and bending resistance of the fixed toner image. Also, the toner stripping and fixing property at a high temperature, that is HOT, and the surface gloss can be ensured. In Comparative Example 1, wherein there was no semicrystalline polymer incorporated into the toner particles, the toner fixing properties at a low temperature of from about 80° C. to about 160° C. were deteriorated. In Comparative Example 1, the toner's MFT of 140° C. was higher than 110° C. In Comparative Example 3, wherein there was no crystalline polymer incorporated into the toner particles, generation of hot offset at a high temperature side of 193° C. and increase in stripping force associated thereto were liable to occur. In Comparative Example 3, the toner's MFT of 188° C. was lower than 100° C., the toner's stripping force of 29.5 g/f was higher than 25 g/f, and the toner HOT of 193° C. was below 200° C. (This toner, when fused, needed higher stripping force than 25 g/f to be peeled off from a fuser roll. Also, this toner had a hot offset temperature (HOT) of 193° C., thus the fused toner tended to adhere to the fixing fixture at a lower temperature of about 195° C. It was desirable to have a toner HOT higher than about 200° C., and preferably higher than 210° C., of from about 210° C. to about 250° C. to, for example, prevent hot offset). In Comparative Example 4, wherein there was neither a semicrystalline polymer nor a crystalline polymer incorporated into the toner particles, the toner fixing properties at a low temperature were deteriorated. Generation of hot offset at a high temperature and increase in stripping force associated thereto were liable to occur. In Comparative Example 4, the toner's MFT of 142° C. was higher than 110° C., the toner's stripping force of 34.5 g/f was higher than 25 g/f, and the toner HOT of 180° C. was below 200° C. (This toner, when fused, needed higher stripping force to be peeled off from a fuser roll. Also, this toner had a hot offset temperature (HOT) of 180° C., thus the fused toner tended to adhere to the fixing fixture at lower temperature of about 195° C. It was desirable to have a toner HOT higher than about 200° C., and more specifically, higher than 210° C., and yet more specifically, of from about 210° C. to about 250° C. to, for example, prevent hot offset).

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. A toner comprised of a mixture of a semicrystalline polymer containing from about 10 to about 60 percent crystallinity, an amorphous polymer and a high crystalline polyolefin; and a colorant.

2. A toner in accordance with claim 1 wherein said semicrystalline polymer possesses from about 12 to about 50 percent crystallinity.

3. A toner in accordance with claim 1 wherein said semicrystalline polymer possesses a melting point temperature of from about 50° C. to about 110° C.

4. A toner in accordance with claim 1 wherein said semicrystalline polymer possesses a melting point temperature of from about 55° C. to about 90° C.

5. A toner in accordance with claim 1 wherein said semicrystalline polymer possesses a melting point temperature of from about 50° C. to about 110° C.

6. A toner in accordance with claim 2 wherein said semicrystalline polymer possesses a melting point temperature of from about 50° C. to about 110° C.

7. A toner in accordance with claim 1 wherein said semicrystalline polymer possesses a melting point temperature of from about 55° C. to about 90° C.

8. A toner in accordance with claim 2 wherein said semicrystalline polymer possesses a melting point temperature of from about 55° C. to about 90° C.

9. A toner in accordance with claim 1 wherein said semicrystalline polymer is present in an amount of from about 2 to about 30 percent by weight.

10. A toner in accordance with claim 1 wherein said semicrystalline polymer is present in an amount of from about 4 to about 25 percent by weight.

11. A toner in accordance with claim 1 wherein said semicrystalline polymer is polyacetone, polycaprolactone, poly(alkyl vinyl ether), poly(alkyl acrylate), poly(alkyl methacrylate), poly(olefin-vinyl acetate), polyacetal, poly (olefin oxide), poly(olefin oxalate), poly(olefin terephthalate), or poly(dialkyl siloxane).

12. A toner in accordance with claim 1 wherein said semicrystalline polymer is polyacetone, polycaprolactone, poly(ethyl vinyl ether), poly(dodecyl acrylate), poly(octadecyl acrylate), poly(octadecyl methacrylate), poly(behenylpolyethoxyethyl methacrylate), poly(ethylene-p-carboxy phenoxy-butyrate), poly(vinyl butyral), poly(ethylene-vinyl acetate), poly(hexamethylene oxalate), poly(decamethylene oxalate), poly(ethylene oxide), poly(propylene oxide), poly (butadiene oxide), poly(decamethylene oxide), poly(methyl ethylene terephthalate), or poly(dimethyl siloxane).

13. A toner in accordance with claim 1 wherein said semicrystalline polymer is polycaprolactone, poly(vinyl butyral), poly(ethylene-vinyl acetate), poly(ethylene oxide), poly(octadecyl acrylate), poly(octadecyl methacrylate), poly (behenylpolyethoxyethyl methacrylate), or poly(ethylene-vinyl acetate).

14. A toner in accordance with claim 1 wherein said amorphous polymer possesses a glass transition temperature of from about 40° C. to about 80° C.

15. A toner in accordance with claim 1 wherein said amorphous polymer possesses a glass transition temperature of from about 48° C. to about 60° C., or wherein said crystalline polyolefin possesses a crystalline percent of from about 60 to about 95 percent.

16. A toner in accordance with claim 1 wherein said crystalline polyolefin is polyethylene.

17. A toner in accordance with claim 1 wherein said crystalline polyolefin is polypropylene.

18. A toner in accordance with claim 1 wherein said crystalline polyolefin is a copolymer of polyethylene and polypropylene optionally containing functional groups.

19. A toner in accordance with claim 18 wherein said crystalline polyolefin contains functional carboxy groups, or functional hydroxyl groups.

20. A process for the preparation of a toner comprised of the mixing of a polymer latex comprised of semicrystalline polymer containing from about 10 to about 60 percent crystallinity, an amorphous polymer and a high crystalline polyolefin and colorant; followed by heating below the amorphous polymer Tg (glass transition) temperature, and then subsequently heating above the amorphous polymer Tg.

21. A process in accordance with claim 20 wherein said below Tg is from about 1° C. to about 30° C.

22. A process in accordance with claim 20 wherein said above Tg is from about 15° C. to about 55° C.

23. A process in accordance with claim 20 wherein there is further included a coagulant, and optionally which coagulant is a polyaluminum halide.

24. A process in accordance with claim 23 wherein said coagulant is a polyaluminum chloride.

25. A process in accordance with claim 23 wherein said coagulant is an organic aliphatic amino ester selected from the group consisting of tri(2-aminoethyl) citrate, 2-aminoethyl ester, 3-aminopropyl ester, 4-aminobutyl ester, 4-aminobutyroate, 5-aminopentanoate, 6-aminocaproate, quaternary ammonium ester, tertiary aminoester, aminosulfonate, aminosulfonite, aminophosphorate, and aminophosphorite.

26. A process in accordance with claim 20 wherein said below Tg heating causes aggregation, and optionally which Tg temperature is from about 40° C. to about 60° C., and said heating above said Tg enables coalescence, and optionally which heating temperature is from about 75° C. to about 97° C.

27. A process in accordance with claim 20 wherein said colorant is a pigment, and wherein said pigment is in the form of a dispersion, which dispersion contains an ionic surfactant, and wherein said process further includes the addition of a polyamine salt that primarily functions as a coagulant to enable aggregation of said latex and said colorant.

28. A process in accordance with claim 20 wherein the latex polymer is selected from the group consisting of poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly (styrene-butyl acrylate), poly(styrene-butadiene-acrylic acid), poly(styrene-butadiene-methacrylic acid), poly(styrene-butadiene-acrylonitrile-acrylicacid), poly(styrene-butyl acrylate-acrylic acid), poly(styrene-butyl acrylate-methacrylic acid), poly(styrene-butyl acrylate-acrylononitrile), poly(styrene-butyl acrylate-acrylononitrile-acrylic acid), poly(styrene-butadiene-β-carboxyethyl acrylate), poly(styrene-butadiene-acrylonitrile-β-carboxyethyl acrylate), poly (styrene-butyl acrylate-β-carboxyethyl acrylate), and poly (styrene-butyl acrylate-acrylononitrile-β-carboxyethyl acrylate).

29. A toner in accordance with claim 1 wherein the colorant is carbon black, cyan, yellow, magenta, or mixtures thereof; the toner isolated is optionally from about 2 to about 15 microns in volume average diameter, and the particle size distribution thereof is optionally from about 1.15 to about 1.30; and wherein there is added to the surface of the formed toner metal salts, metal salts of fatty acids, silicas, metal oxides, or mixtures thereof, each in an amount of from about 0.1 to about 10 weight percent of the obtained toner.

30. A toner in accordance with claim 2 wherein said semicrystalline polymer possesses a weight average molecular weight $M_w$ of from about 7,000 to about 200,000, and a number average molecular weight $M_n$ of from about 1,000 to about 60,000, or wherein said semicrystalline resin possesses a weight average molecular weight $M_n$ of from about 10,000 to about 150,000, and a number average molecular weight $M_n$ of from about 3,000 to about 50,000.

31. A toner in accordance with claim 1 further containing a wax and optionally toner additives.

32. A process comprising the heating of latexes comprised of a first latex, a second latex, and a third latex wherein said first latex contains a semicrystalline polymer, said second latex contains an amorphous polymer, and said third latex contains a crystalline polyolefin and colorants; and wherein said heating comprises a first heating below about the Tg of said amorphous polymer, and a second subsequent heating above about the Tg of said amorphous polymer.

33. A process in accordance with claim 20 wherein said below Tg is from about 1° C. to about 20° C.

34. A process in accordance with claim 20 wherein said below Tg is from about 20° C. to about 45° C.

* * * * *